US009127629B2

(12) United States Patent
Yamada et al.

(10) Patent No.: US 9,127,629 B2
(45) Date of Patent: Sep. 8, 2015

(54) FUEL INJECTION DEVICE

(75) Inventors: Masato Yamada, Obu (JP); Yoichi Kobane, Kuwana (JP); Naofumi Adachi, Takahama (JP); Tsukasa Yamashita, Kariya (JP)

(73) Assignee: DENSO CORPORATION, Kariya (JP)

( * ) Notice: Subject to any disclaimer, the term of this patent is extended or adjusted under 35 U.S.C. 154(b) by 941 days.

(21) Appl. No.: 13/318,527

(22) PCT Filed: Mar. 31, 2011

(86) PCT No.: PCT/JP2011/001970

§ 371 (c)(1),
(2), (4) Date: Nov. 2, 2011

(87) PCT Pub. No.: WO2011/122051

PCT Pub. Date: Oct. 6, 2011

(65) Prior Publication Data

US 2012/0042852 A1 Feb. 23, 2012

(30) Foreign Application Priority Data

Mar. 31, 2010 (JP) ..... 2010-80838
Dec. 3, 2010 (JP) ..... 2010-270647

(51) Int. Cl.
*F02M 61/10* (2006.01)
*F02M 61/00* (2006.01)
(Continued)

(52) U.S. Cl.
CPC ..... *F02M 47/027* (2013.01); *F02M 47/025* (2013.01); *F02M 61/161* (2013.01); *F02M 2547/008* (2013.01)

(58) Field of Classification Search
CPC .. F02M 61/161; F02M 47/025; F02M 47/027
USPC ..... 239/533.2, 584, 5, 585.1–585.5, 239/533.11–533.13
See application file for complete search history.

(56) References Cited

U.S. PATENT DOCUMENTS 4,826,080 A 5/1989 Ganser
6,092,737 A 7/2000 Bosch et al.
(Continued)

FOREIGN PATENT DOCUMENTS

EP 1656498 3/2005
JP 2-146255 6/1990
(Continued)

OTHER PUBLICATIONS

Office Action (6 pages) dated Jul. 22, 2013, issued in corresponding Chinese Application No. 201180002506.0 and English translation (5 pages).
(Continued)

*Primary Examiner* — Len Tran
*Assistant Examiner* — Tuongminh Pham
(74) *Attorney, Agent, or Firm* — Nixon & Vanderhye P.C.

(57) ABSTRACT

A fuel injection device (100) includes a control body (40) provided with an injection hole (44), a nozzle needle (60) that opens or closes the injection hole (44), a pressure control chamber (53) controlling a movement of the nozzle needle (60), an inflow channel (52) through which high-pressure fuel is introduced to the pressure control chamber (53), an outflow channel (54) through which the fuel from the pressure control chamber (53) is discharged, and a floating plate (70) that opens or closes the inflow channel (52). In the fuel injection device (100), the control body (40) includes a cylinder (56) defining the pressure control chamber (53) in a radial direction thereof, and an inner wall portion (56*a*) of the cylinder (56) includes a communication groove (57*a*) which causes an inflow chamber (53*a*) that is provided within the pressure control chamber (53) at a side of the inflow channel (52) relative to the floating plate (70), to communicate with a back pressure chamber (53*b*) that is provided within the pressure control chamber (53) at a side of the nozzle needle (60) relative to the floating plate (70).

16 Claims, 9 Drawing Sheets

(51) Int. Cl.
*F02M 47/02* (2006.01)
*F02M 61/16* (2006.01)

(56) References Cited

U.S. PATENT DOCUMENTS

| | | | | |
|---|---|---|---|---|
| 6,474,572 | B1 * | 11/2002 | Tsuchiya et al. | 239/585.1 |
| 6,892,955 | B2 | 5/2005 | Grabandt | |
| 7,124,966 | B2 * | 10/2006 | Schlairet | 239/533.2 |
| 7,694,891 | B2 * | 4/2010 | Sturman | 239/5 |
| 2003/0052198 | A1 | 3/2003 | Tappolet et al. | |
| 2009/0065614 | A1 * | 3/2009 | Ganser | 239/584 |
| 2012/0175435 | A1 | 7/2012 | Yamashita | |

FOREIGN PATENT DOCUMENTS

| | | |
|---|---|---|
| JP | 8-232812 | 9/1996 |
| JP | 2008-175155 | 7/2008 |
| JP | 2009-250074 | 10/2009 |
| WO | WO 2005/019637 | 3/2005 |

OTHER PUBLICATIONS

International Search Report for PCT/JP2011/001970 mailed May 17, 2011.

Written Opinion of the International Searching Authority mailed May 17, 2011.

Office Action (8 pages) dated May 23, 2013, issued in copending U.S. Appl. No. 13/343,126 of Yamashita, filed Jan. 4, 2012.

Office Action (2 pages) dated Jun. 3, 2014, issued in corresponding Japanese Application No. 2010-270647 and English translation (4 pages).

Office Action (4 pages) dated Feb. 25, 2014, issued in corresponding Chinese Application No. 201180002506.0 and English translation (4 pages).

* cited by examiner

FUEL INJECTION DEVICE

This application is the U.S. national phase of International Application No. PCT/JP2011/001970 filed 31 Mar. 2011 which designated the U.S. and claims priority to JP 2010-80838 filed 31 Mar. 2010 and Jp 2010-270647 filed 3 Dec. 2010, the entire contents of each of which are hereby incorporated by reference.

CROSS REFERENCE TO RELATED APPLICATION

This application is based on Japanese Patent Applications No. 2010-080838 filed on Mar. 31, 2010, and No. 2010-270647 filed on Dec. 3, 2010, the disclosures of which are incorporated herein by reference.

TECHNICAL FIELD

The present invention relates to a fuel injection device that injects high-pressure fuel to a combustion chamber of an internal combustion engine.

BACKGROUND ART

There has been known a fuel injection device including a valve body, which has a high-pressure fuel passage and a pressure control chamber therein, and a valve member for opening/closing an injection hole in response to a valve member movement in an axial direction of the valve body in an inside thereof. The valve member movement is controlled by fuel pressure in the pressure control chamber. For instance, as a kind of the fuel injection device, Patent Document 1 teaches a technique of the fuel injection device having a control member, which is movable in the axial direction of the valve body in the pressure control chamber and opens or closes an inflow channel. When the control member closes the inflow channel, it can prevent an inflow of high-pressure fuel into the pressure control chamber. The fuel pressure in the pressure control chamber is rapidly decreased by the operation of the control member. Thus, the valve member, which is controlled by the fuel pressure in the pressure control chamber, can rapidly open the injection hole.

PRIOR ART DOCUMENT

Patent Document

[Patent Document 1] EP Patent No. 1656498

In the fuel injection device disclosed in the patent document 1, the pressure control chamber may be divided by the control member therein. In order to prevent a deterioration of pressure recovery in a back pressure chamber, which is located at the valve member side with respect to the control member in the pressure control chamber, a passage of the fuel flowing from an inflow chamber, which is located at inflow channel side with respect to the control member in the pressure control chamber, to the back pressure chamber needs to be provided. Therefore, a clearance, through which the fuel can flow, may be provided between an inner wall surface portion defining the pressure control chamber and an outer wall surface portion that is one of the control members and opposed to the inner wall surface portion.

However, when the clearance between the inner wall surface portion defining the pressure control chamber and the wall surface portion of the control member is enlarged for providing a sufficient channel area of a passage of the fuel flow, the control member will possibly be inclined with respect to the axial direction of the valve body. It may be difficult for the inclined control member to smoothly displace and reciprocate in the pressure control chamber, so that an opening operation of the inflow channel to the pressure control chamber may be deteriorated. As a result, the control member may limit to lead the fuel flowing into the pressure control chamber.

When the clearance between the inner wall surface portion defining the pressure control chamber and the wall surface portion of the control member is narrowed so as to restrict the inclination of the control member, the pressure recovery in the back pressure chamber may need longer time. On the other hand, when the clearance between the inner wall surface portion defining the pressure control chamber and the control member is enlarged for rapid pressure recovery in the back pressure chamber, the flow of the high-pressure fuel into the inflow chamber is restricted, so that it may be difficult to improve the pressure recovery in the back pressure chamber. Thus, it may be difficult to improve the response of the valve member when the valve is closed.

SUMMARY

In view of the foregoing and other problems, it is an object of the present invention to provide a fuel injection device, which can improve a response of the valve member at the valve closing time.

According to an example of the present invention, a fuel injection device includes: a valve body in which a high-pressure fuel passage is provided and which has an injection hole at a tip end, from which the high-pressure fuel is injected into a combustion chamber of an internal combustion engine; a valve member which is movable in an axial direction of the valve body in an inside of the valve body, and opens or closes the injection hole; a pressure control chamber which is provided within the valve body at a side opposite from the injection hole with respect to the valve member, and which introduces the high-pressure fuel and controls the movement of the valve member by using fuel pressure; an inflow channel through which the high-pressure fuel is introduced to the pressure control chamber; an outflow channel through which the fuel from the pressure control chamber is discharged to an exterior low-pressure side; and a control member which is movable in the axial direction of the pressure control chamber in an inside of the pressure control chamber, and opens or closes the inflow channel. In the fuel injection device, the valve body includes a cylindrical inner wall portion defining the pressure control chamber in a radial direction thereof, and the cylindrical inner wall portion includes a communication groove which causes an inflow chamber that is provided within the pressure control chamber at a side of the inflow channel relative to the control member, to communicate with a back pressure chamber that is provided within the pressure control chamber at a side of the valve member relative to the control member.

According to the above aspect of the present invention, through the communication groove arranged at the cylindrical inner wall portion, the fuel introduced into the inflow chamber, which is located in the pressure control chamber on the side of the inflow channel relative to the control member, flows into the back pressure chamber, which is located in the pressure control chamber on the side of the valve member relative to the control member. Therefore, a sufficient channel area for allowing the fuel to flow from the inflow chamber to the back pressure chamber is ensured, so that it can prevent the pressure recovery in the back pressure chamber from being interrupted by the control member.

On the other hand, due to the providing of the sufficient channel area by arranging the communication groove, a clearance between the cylindrical inner wall portion and a wall portion of the control member, which is opposed to the cylindrical inner wall portion in a radial direction, can be reduced. The reduction of the clearance can limit the displacement axis of the control member from being inclined relative to the axial direction of the valve body. Thus, this allows the control member to smoothly displace within the pressure control chamber, so that a quick opening operation of the inflow channel to the pressure control chamber can be achieved. As a result, it can prevent the fuel introduction into the pressure control chamber from being restricted by the control member.

Thus, when the control member opens the inflow channel, the fuel is introduced quickly into the inflow chamber, and furthermore, the fuel can smoothly flow into the back pressure chamber. Thereby, a time period needed for the pressure recovery until the valve member starts moving can be shortened, so that a response of the valve member at valve closing time in the fuel injection device can be improved.

For example, the cylindrical inner wall portion may be provided with a slidable contact wall surface that slidably contacts an outer peripheral wall portion around the displacement axis of the control member. Therefore, the sufficient channel area causing the inflow chamber to communicate with the back pressure chamber is ensured by arranging the communication groove. Thus, even if the slidable contact wall surface that slidably contacts the outer peripheral wall portion around the displacement axis of the control member is arranged on the cylindrical inner wall portion, it can prevent the pressure recovery in the back pressure chamber from being interrupted by the control member. In addition, making the control member be displaced and reciprocated on the slidable contact wall surface can accurately limit an inclination of the axis of the control member. Thus, the control member can accurately displace and reciprocate in the pressure control chamber, so that a high-pressure fuel introduction into the inflow channel can be performed without being interrupted. Therefore, the time period needed for the pressure recovery in the back pressure chamber is accurately shortened, so that the response of the valve member at the valve closing time can be effectively improved.

In addition, the cylindrical inner wall portion may be provided with a communication wall surface defining a communication clearance between the cylindrical inner wall portion and an outer peripheral wall around a displacement axis of the control member, and the communication clearance causes the inflow chamber to communicate with the back pressure chamber.

Thus, the sufficient channel area is ensured by arranging the communication groove, so that the channel area defined by the communication clearance is not necessary to be enlarged. Therefore, a size of the communication clearance can be made smaller, so as to restrict the inclination of the axis of the control member. Even if the channel area of the communication clearance is small as described above, the forming of the communication clearance results in the enlargement of total area of the passage connecting the inflow chamber and the back pressure chamber. Thus, the time period taken for the pressure recovery in the back pressure chamber can be shortened, so that the response of the valve member at the valve closing time can be improved.

In addition, in a radial cross section, a bottom portion of the communication groove may have an arcuate shape. In this case, high pressure by the high-pressurized fuel is applied to the communication groove through which high-pressurized fuel flows. Because the bottom portion of the communication groove is configured into the arcuate shape, stress may not be collected at the vicinity of the bottom portion of the communication groove on the cylindrical inner wall portion. Thus, it can prevent deterioration of the cylindrical inner wall portion, which is caused by providing the communication groove. Therefore, the response of the valve member at the valve closing time in the fuel injection device can be improved, while high endurance of the fuel injection device is achieved.

In addition, a plurality of the communication grooves may be arranged on the cylindrical inner wall portion and spaced from each other in a circumferential direction of the cylindrical inner wall portion. In this case, the channel area of the passage, through which the fuel flows from the inflow chamber to the back pressure chamber, can be easily enlarged. Thus, this allows a large amount of the fuel to flow into the back pressure chamber, so that the pressure recovery in the back pressure chamber can be quickly achieved. Therefore, the response of the fuel injection device at the valve closing time can accurately be improved.

Furthermore, the communication grooves may be equally spaced from each other in the circumferential direction. In this case, fuel flow around the control member can become in uniform. Thus, it limits the inclination of the control member. Arranging the multiple communication grooves results in an increase of the flow amount of the fuel flowing into the back pressure chamber. Furthermore, the even fuel flow is achieved by arranging the communication grooves at equal intervals, thereby quickly achieving the pressure recovery in the back pressure chamber without variation. Thus, a movement start time of the valve member is brought forward, and time fluctuation can be limited to small. Therefore, the response of the valve member at the valve closing time in the fuel injection device can be improved and to be stable.

In addition, the valve body may be provided with a limiting portion, which is opposed to an end surface of the control member on a side of the back pressure chamber and restricts a displacement of the control member by contacting the end surface thereof during a displacement in a direction detaching from the inflow channel. Furthermore, the limiting portion may be provided with a sub-communication groove making the inflow chamber communicate with the back pressure chamber together with the communication groove.

Thus, the arrangement of the limiting portion, which restricts the displacement of the control member by contacting the control member end surface located on the side of the back pressure chamber, results in the limitation of the control member displacement in the direction detaching from the inflow channel. Therefore, the displacement amount of the control member is limited by the limiting portion. Thereby, at the time of closing the valve member, the control member quickly closes the inflow channel and stops introducing the high-pressurized fuel into the pressure control chamber.

Furthermore, the sub-communication groove, which causes the inflow chamber to communicate with the back pressure chamber together with the communication groove, is provided in the limiting portion. Therefore, the fuel flow from the inflow chamber to the back pressure chamber can be ensured, so that it prevents the pressure recovery in the back pressure chamber from being interrupted by the contact between the end surface and the limiting portion. Thus, the response of the valve member at both the valve closing time and the valve opening time can be improved in the fuel injection device.

Furthermore, the limiting portion can be configured in a stepped shape protruding in a radially inside direction on the cylindrical inner wall portion, so that the limiting portion can accurately restrict the displacement of the control member, while this structure is simple.

A channel area of the sub-communication groove may be configured to become larger in the flow direction from the inflow chamber to the back pressure chamber as approaching the downstream in the flow direction.

In this case, pressure of the fuel flowing through the sub-communication groove becomes lower as approaching the fuel downstream side. Thereby, the fuel flowing through the communication groove and the sub-communication groove is attracted toward the downstream side, so that this allows the fuel to flow more smoothly from the inflow chamber into the back pressure chamber. Thus, the time period taken for the pressure recovery until the valve member starts moving can be shortened, and thereby the response of the valve member at the valve closing time can be further improved.

For example, the cylindrical inner wall portion may be provided with the communication grooves equally spaced from each other in the circumferential direction of the cylindrical inner wall portion, the limiting portion may be provided with the sub-communication grooves, which are connected to the multiple communication grooves respectively and are spaced from each other in the circumferential direction, and the communication grooves and the sub-communication grooves may be equally spaced each other in the circumferential direction.

In this case, the channel area of the passage through which the fuel flows from the inflow chamber to the back pressure chamber can be easily enlarged. In addition, by equally spacing the multiple communication grooves and multiple sub-communication grooves from each other in the circumferential direction of the cylindrical inner wall portion, the fuel can flow in uniform around the control member. Thus, it limits the inclination of the control member. As described above, by enlarging the channel area while stabilizing the posture of the floating plate, the pressure recovery in the back pressure chamber can be achieved quickly and smoothly. Thus, the movement start time of the valve member can be brought forward, and the time fluctuation can be small. Therefore, the response of the valve member at the valve closing time can be steadily heightened.

In addition, in a radial cross section, the bottom portion of the communication groove may be configured in an arcuate shape, and the sub-communication groove may be configured in a circular arc shape, which is co-axial with the bottom portion and has a same radius as the bottom portion.

Thus, at the time of forming the communication grooves and the sub-communication grooves on the valve body by a cutting, the cutting processes for forming the communication grooves and the sub-communication grooves can be conducted at the same time with a same tool. Therefore, due to the configuration capable to form the communication groove and the sub-communication groove at the same time, it is possible to provide the valve body having both the communication groove and the sub-communication groove with low manufacturing cost of the cylinder. Thereby, the response of the valve member at both the valve closing time and the valve opening time in the fuel injection device can be improved with lower manufacturing cost.

In addition, a center of the circular arc shape of the sub-communication groove may be located on an inner peripheral side of the limiting portion in a radial direction thereof. In this case, the channel area of the sub-communication groove becomes larger in the flow direction from the inflow chamber to the back pressure chamber, as approaching the downstream in the flow direction. Thus, the fuel can flow smoothly from the inflow chamber into to back pressure chamber, so that the response of the valve member at the valve closing time can be further improved.

In addition, knurling may be provided on the cylindrical inner wall portion as the communication grooves. Even in this case, the fuel can flow from the inflow chamber to the back pressure chamber. Preferably, knurling defined in the JISB-0951, for example, such as a parallel-type knurling in which multiple grooves extend along the axial direction or a diamond knurling in which each groove is crossed each other and this makes stripe pattern, is suitable in this case.

In addition, due to the configuration of the communication groove extending in the axial direction of the valve body, the resistance of the high-pressurized fuel flow through the communication groove can be reduced. Thus, the fuel can flow more smoothly from the inflow chamber to the back pressure chamber. Therefore, the time period needed for the pressure recovery in the back pressure chamber can be more shortened, so that the response of the valve body at the valve closing time can be more effectively improved.

Furthermore, the configuration of the communication groove is not limited to the shape extending along the axial direction, so that the communication groove can be spirally wound around and extend along the central axis of the cylindrical inner wall portion.

In addition, the valve body may be provided with a supply passage through which the high-pressurized fuel flows into the injection hole arranged in a tip end thereof, and may have a cylindrical member, which is held in the supply passage, configures the cylindrical inner wall portion on the inner circumferential side, and divides the pressure control chamber from the supply passage.

Moreover, the valve body may include a nozzle member forming the tip end, on which the injection hole is arranged, and the nozzle member may configure the pressure control chamber defined by the cylindrical inner wall portion and the supply passage, which is located on an outer peripheral side of the pressure control chamber and supplies the high-pressurized fuel to the injection hole.

As described above, the component that defines the pressure control chamber may be changed, depending on the configuration of the fuel injection device. However, regardless of the component defining the pressure control chamber, if the communication groove is formed on the cylindrical inner wall portion that defines the pressure control chamber and this allows the fuel flow into the back pressure chamber, the pressure recovery in the back pressure chamber can be quickly achieved. Thus, regardless of the configuration of the fuel injection device, the forming the communication groove results in the improvement of the response of the valve member at the valve closing time.

PREFERRED EMBODIMENTS FOR CARRYING OUT THE INVENTION

Figure 1:
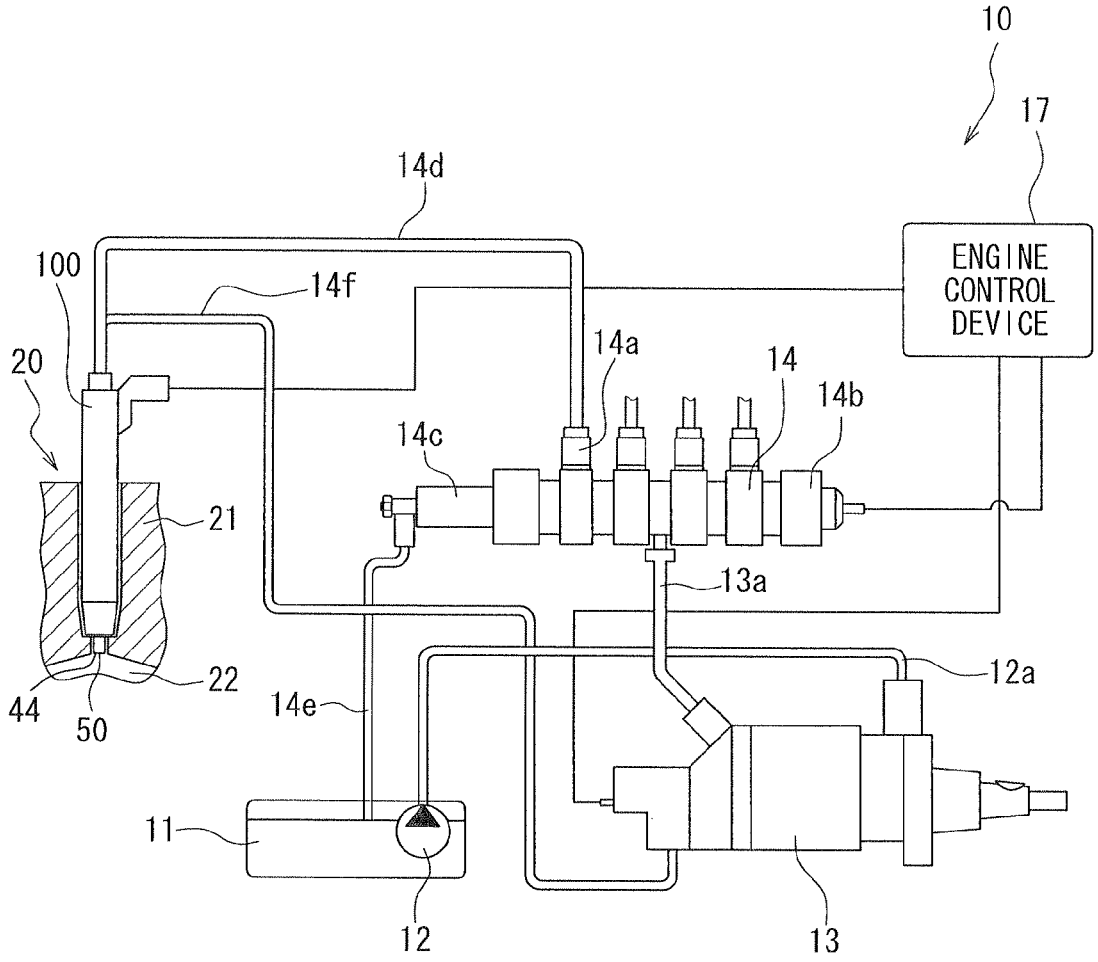
FIG. 1 is a schematic diagram of a fuel supply system having a fuel injection device according to a first embodiment of the present invention.

Various embodiments of the present invention will be described with reference to the accompanying drawings. In the following embodiments, similar or corresponding components will be indicated by the same reference numerals and will not be described redundantly for the sake of simplicity.

(First Embodiment)

A fuel supply system 10, in which a fuel injection device 100 according to a first embodiment of the present invention is used, is shown in FIG. 1. The fuel supply system 10 is a so-called direct injection fuel supply system, in which fuel is directly injected into a combustion chamber 22 of a diesel engine 20 as an internal combustion engine.

The fuel supply system 10 is constructed of a feed pump 12, a high-pressure fuel pump 13, a common rail 14, an engine control device 17 (engine ECU), the fuel injection device 100, and the like.

The feed pump 12 is an electrically driven pump and is housed in a fuel tank 11. The feed pump 12 applies a feed pressure to fuel stored in the fuel tank 11, such that the feed pressure is higher than the vapor pressure of the fuel. The feed pump 12 is connected to the high-pressure fuel pump 13 with a fuel pipe 12*a* and supplies the liquid-state fuel, which has a predetermined feed pressure applied thereto, to the high-pressure fuel pump 13. The fuel pipe 12*a* has a pressure control valve (not shown) fitted thereto, and the pressure of the fuel supplied to the high-pressure fuel pump 13 is held at a specified value.

The high-pressure fuel pump 13 is attached to the diesel engine 20 and is driven by power from an output shaft of the diesel engine 20. The high-pressure fuel pump 13 is connected to the common rail 14 by a fuel pipe 13*a*, and further applies pressure to the fuel supplied by the feed pump 12 to supply a high-pressure fuel to the common rail 14. In addition, the high-pressure fuel pump 13 has an electromagnetic valve (not shown) electrically connected to the engine control device 17. The electromagnetic valve is opened or closed by the engine control device 17, and thereby the pressure of the fuel supplied from the high-pressure fuel pump 13 to the common rail 14 is optimally controlled to a predetermined pressure.

The common rail 14 is a pipe-shaped member made of a metal material such as chromium molybdenum steel and has a plurality of branch parts 14*a*. The number of the plurality of branch parts 14*a* corresponds to the number of cylinders per bank of the diesel engine. Each of the branch parts 14*a* is connected to the fuel injection device 100 by a fuel pipe forming a supply channel 14*d*. The fuel injection device 100 and the high-pressure fuel pump 13 are connected to each other by a fuel pipe forming a return channel 14*f*. According to the above-mentioned construction, the common rail 14 temporarily stores the fuel supplied in a high-pressure state by the high-pressure fuel pump 13, and distributes the fuel to the plurality of fuel injection devices 100 with the pressure held in the high-pressure state through the supply channels 14*d*. In addition, the common rail 14 has a common rail sensor 14*b* provided at one end portion of both end portions in an axial direction, and has a pressure regulator 14*c* provided at the other end portion thereof. The common rail sensor 14*b* is electrically connected to the engine control device 17 and detects the pressure and the temperature of the fuel and outputs them to the engine control device 17. The pressure regulator 14*c* maintains the pressure of the fuel in the common rail 14 at a constant value, and decompresses and discharge excess fuel to a low-pressure side. The excess fuel passing through the pressure regulator 14*c* is returned to the fuel tank 11 through a channel in a fuel pipe 14*e* that connects the common rail 14 to the fuel tank 11.

The fuel injection device 100 is the device for pressurizing the fuel and for injecting the high-pressure fuel supplied through the branch part 14*a* of the common rail 14, from an injection hole 44. Specifically, the fuel injection device 100 has a valve portion 50 that controls the injection of the high-pressure fuel injected from the injection hole 44 based on a control signal from the engine control device 17. The high-pressure fuel is supplied from the high-pressure pump 13 through the supply channel 14*d*. In addition, in the fuel injection device 100, the excess fuel, which is a portion of the high-pressure fuel supplied from the supply channel 14*d* and is not injected from the injection hole 44, is discharged into the return channel 14*f* through which the fuel injection device 100 communicates with the high-pressure fuel pump 13, and then is returned to the high-pressure fuel pump 13. The fuel injection device 100 is inserted and fitted into an insertion hole disposed within a head member 21 that is a portion of the combustion chamber 22 of the diesel engine 20. In the present embodiment, a plurality of the fuel injection devices 100 are arranged for respective combustion chambers 22 of the diesel engine 20, and each of them injects the fuel directly into the combustion chamber 22, specifically, with an injection pressure of a range from 160 to 220 mega Pascal (MPa).

The engine control device 17 is constructed of a microcomputer or the like. The engine control device 17 is electrically connected to not only the common rail sensor 14*b* described above but also various kinds of sensors such as a rotational speed sensor for detecting a rotational speed of the diesel engine 20, a throttle sensor for detecting a throttle opening, an air flow sensor for detecting an intake air volume, a boost pressure sensor for detecting a boost pressure, a water temperature sensor for detecting a cooling water temperature, and an oil temperature sensor for detecting an oil temperature of lubricating oil. The engine control device 17 outputs an electric signal for controlling the opening/closing of the electromagnetic valve of the high-pressure fuel pump 13 and the valve portion 50 of each fuel injection device 100, to the electromagnetic valve of the high-pressure fuel pump 13 and to each fuel injection device 100 based on the signal from the corresponding sensors.

Figure 2:
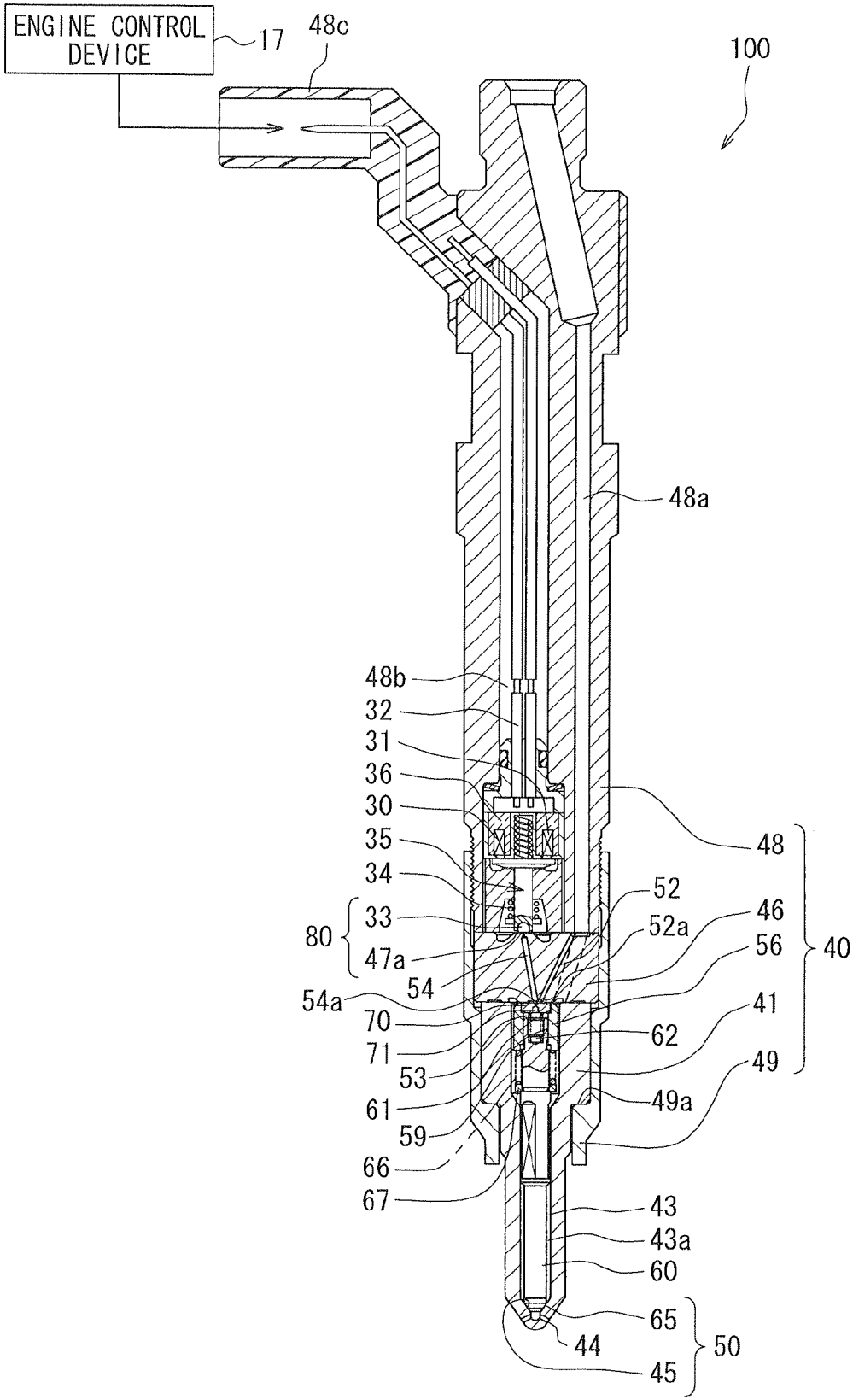
FIG. 2 is a longitudinal section view of the fuel injection device according to the first embodiment of the present invention.

Next, the structure of the fuel injection device 100 will be described in detail on the basis of FIG. 2 or FIG. 3.

The fuel injection device 100 includes a control valve driving part 30, a control body 40, a nozzle needle 60, a spring 76, and a floating plate 70.

The control valve driving part 30 is housed in the control body 40. The control valve driving part 30 includes a terminal 32, a solenoid 31, a fixed member 36, a movable member 35, a spring 34, and a valve seat member 33. The terminal 32, which is made of a metal material having electrical conductivity, has one end portion of both end portions in an extending direction exposed to an outside of the control body 40 and has the other end portion thereof connected to the solenoid 31. The solenoid 31 is spirally wound and is supplied with a pulse current from the engine control device 17 through the terminal 32. When the solenoid 31 is supplied with the pulse current, the solenoid 31 generates a magnetic field circling along the axial direction. The fixed member 36 is a cylindrical member made of a magnetic material and is magnetized in the magnetic field generated by the solenoid 31. The movable member 35 is made of a magnetic material, has cylindrical shape having two steps, and is arranged on a tip side in the axial direction of the fixed member 36. The movable member 35 is attracted to a base end side in the axial direction by the magnetized fixed member 36. The spring 34, which is a coil spring made by winding a metal wire in a circular shape, urges the movable member 35 in a direction to separate the movable member 35 from the fixed member 36. The valve seat member 33 forms a pressure control valve 80 together with a control valve seat portion 47*a* of the control body 40. The control valve seat portion 47*a* will be described later. The valve seat member 33 is arranged on the opposite side of the fixed member 36 in the axial direction of the movable member 35, and is seated on the control valve seat portion 47*a*. When the magnetic field of the solenoid 31 is not generated, the valve seat member 33 is seated on the control valve seat portion 47*a* by the biasing force of the spring 34. When the magnetic field of the solenoid 31 is generated, the valve seat member 33 is separated from the control valve seat portion 47*a*.

The control body 40, which has a nozzle body 41, a cylinder 56, an orifice plate 46, a holder 48, and a retaining nut 49, is an elongated shape and includes a high-pressure fuel passage therein. The nozzle body 41, the orifice plate 46 and the holder 48 are arranged in this order from a tip side in a direction in which they are inserted into the combustion chamber. In addition, the injection hole 44, through which the high-pressure fuel is injected to the combustion chamber 22 (see FIG. 1) of the diesel engine 20, is disposed in a tip end of the control body 40.

The control body 40 has an inflow channel 52, an outflow channel 54, a pressure control chamber 53, and an opening-wall surface 90 exposed to the pressure control chamber 53. One end of the inflow channel 52 communicates with a side of the supply channel 14*d* (see FIG. 1), which is connected to the high-pressure fuel pump 13 and the common rail 14, and the other end of the inflow channel 52 communicates with the pressure control chamber 53. The inflow channel 52 has an opening of an inflow port 52*a*, which is a passage end opposite from a side of the supply channel 14*d*, at the opening-wall surface 90. Thus, high-pressure fuel can be introduced into the pressure control chamber 53 through the inflow channel 52. Further, one end of the outflow channel 54 communicates with a side of the return channel 14*f* (see FIG. 1) connected to the high-pressure fuel pump 13, and the other end of the outflow channel 54 communicates with the pressure control chamber 53. The outflow channel 54 has an opening of an outflow port 54*a*, which is a passage end opposite from a side of the return channel 14*f*, at the opening-wall surface 90. Thus, the fuel in the pressure control chamber 53 can flow into the low-pressure side through the outflow channel 54. The pressure control chamber 53 is defined by the orifice plate 46 and the cylinder 56. The pressure control chamber 53 is provided in the control body 40 at a side opposite from the injection hole 44, with respect to the nozzle needle 60. The pressure control chamber 53 is configured, such that the high-pressure fuel is introduced therein from the inflow channel 52 and is discharged through the outflow channel 54.

The nozzle body 41 is made of a metal material such as chromium molybdenum steel and has a cylindrical shape having a bottom portion. The nozzle body 41 has a nozzle needle housing portion 43, a valve seat portion 45, and the injection hole 44. The nozzle needle housing portion 43 is formed along the axial direction of the nozzle body 41, and is a cylindrical hole in which a nozzle needle 60 is received. The nozzle needle housing portion 43 has high-pressure fuel that is supplied from the high-pressure fuel pump 13 and the common rail 14 (see FIG. 1). A supply passage 43*a*, through which the high-pressure fuel is supplied to the injection hole 44, is defined by the nozzle needle housing portion 43 and the cylinder 56. The valve seat portion 45 is formed on the bottom wall of the nozzle needle housing portion 43 and contacts with the tip end of the nozzle needle 60. The injection hole 44 is arranged in the tip end of the nozzle body 41, which is opposite from the orifice plate 46 with respect to the valve seat portion 45. A plurality of the injection holes 44 radiating from an inside of the nozzle body 41 to an outside of the nozzle body 41 is formed. When the high-pressure fuel passes through the injection holes 44, the high-pressure fuel is atomized and diffused, and thereby the fuel may be easily mixed with air.

The cylinder 56 made of a metal material defines the pressure control chamber 53 in a radial direction of the chamber 53. In addition, the cylinder 56 is coaxially received and arranged within the nozzle needle housing portion 43, and defines the supply passage 43*a* and the pressure control chamber 53.

The cylinder 56 has an inner wall surface portion 56*a*, which has a cylindrical shape. The inner wall surface portion 56*a* is provided with a control wall surface portion 57, a cylinder sliding surface portion 59, a plate stopper portion 58*a*, and a needle stopper portion 58*b*. The control wall surface portion 57 is located on a side of the valve body 46 in an axial direction of the cylinder 56, and circularly encloses the opening-wall surface 90. The cylinder sliding surface portion 59 is arranged in a location, which is opposite from the orifice plate 46 in the axial direction of the cylinder 56, such that the nozzle needle 60 is slidable on the cylinder sliding surface portion 59 along the axial direction. An inner diameter of the cylinder sliding surface portion 59 is reduced with respect to an inner diameter of the control wall surface portion 57.

The plate stopper portion 58*a* has a stepped shape, which protrudes toward a radially inside of the inner wall surface portion 56*a*, and is configured by the differential between the inner diameter of the cylinder sliding surface portion 59 and the control wall surface portion 57. The plate stopper portion 58*a* is opposite from the floating plate 70 in the axial direction of the cylinder 56. The plate stopper portion 58*a* is configured to contact the floating plate 70 by the displacement thereof separating from the inflow channel 52, so as to control the displacement of the floating plate 70 toward the nozzle needle 60. The needle stopper portion 58*b* is arranged at an opposite side, which is opposite from the control wall surface portion 57 relative to the cylinder sliding surface portion 59 in the axial direction of the cylinder 56. The needle stopper portion 58*b* faces toward a side that is opposite from the plate stopper portion 58*a* in the axial direction of the cylinder 56, so as to control the displacement of the nozzle needle 60 toward the floating plate 70.

The orifice plate 46, which is made of a metal material such as chromium molybdenum steel, has a cylindrical shape member and is held between the nozzle body 41 and the holder 48. The orifice plate 46 includes the control valve seat portion 47*a*, the opening-wall surface 90, the outflow channel 54, and the inflow channel 52. The control valve seat portion 47*a* is arranged at one end surface of the orifice plate 46, which is a side of the holder 48 in the axial direction of the orifice plate 46, and configures the pressure control valve 80 together with the valve seat member 33 of the control valve driving part 30. The opening-wall surface 90 is a plane surface, which is arranged on a side of the nozzle body 41 and configured in a central portion in the radial direction of the other end surface of the orifice plate 46. The opening-wall surface 90 is surrounded by the cylinder 56 and has a circular shape. The outflow channel 54 extends toward the control valve seat portion 47*a* from a radially central portion of the opening-wall surface 90. The outflow channel 54 is inclined with respect to the axial direction of the orifice plate 46. The inflow channel 52 extends toward the one end surface, which has the control valve seat portion 47*a*, from the radially outside of the outflow channel 54 in the opening-wall surface 90. The inflow channel 52 is inclined with respect to the axial direction of the orifice plate 46.

The holder 48 is a member made of a metal material such as chromium molybdenum steel in the shape of a cylinder, has longitudinal holes 48*a*, 48*b* formed along the axial direction, and has a socket portion 48*c*. The longitudinal hole 48*a* is a fuel channel that makes the supply channel 14*d* (see FIG. 1) communicate with the inflow channel 52. On the other hand, the longitudinal hole 48*b* has therein the control valve driving part 30 on a side of the orifice plate 46. In addition, in the longitudinal hole 48*b*, the socket portion 48*c* is configured at a portion opposite from the orifice plate 46, to block the opening of the longitudinal hole 48*b*. The socket portion 48*c* has one end of the terminal 32 of the control valve driving part 30 projected thereinto and has a plug portion (not shown) detachably fitted therein. The plug portion is connected to the engine control device 17. When the socket portion 48*c* is connected to the plug portion (not shown), a pulse current may be supplied to the control valve driving part 30 from the engine control device 17.

The retaining nut 49 is made of a metal material and has the cylindrical shape with two steps. The retaining nut 49 receives a portion of the nozzle body 41 and the orifice plate 46, and is threaded onto the side of the orifice plate 46 of the holder 48. In addition, the retaining nut 49 has a stepped portion 49*a* on the inner peripheral wall portion thereof. When the retaining nut 49 is fitted to the holder 48, the stepped portion 49*a* presses the nozzle body 41 and the orifice plate 46 toward the holder 48. In this manner, the retaining nut 49 holds the nozzle body 41 and the orifice plate 46, together with the holder 48.

The nozzle needle 60, which is made of a metal material such as high-speed tool steel, is configured in a generally cylindrical shape, and is capable to move in the control body 40 along the axial direction of the control body 40. The nozzle needle 60 has a seat portion 65, a pressure receiving surface 61, a spring housing portion 62, a needle sliding portion 63, a needle anchoring portion 68, a return spring 66, and a collar member 67. The seat portion 65 is formed on an end portion, which is one of both end portions in the axial direction of the nozzle needle 60 and is arranged opposite to the pressure control chamber 53, and is seated on the valve seat portion 45 of the control body 40. The seat portion 65 and the valve seat portion 45 configure a valve portion 50 that opens or closes the injection hole 44, through which the high-pressure fuel supplied into the nozzle needle housing portion 43 is discharged.

The pressure receiving surface 61 is formed of an end portion, which is one of both end portions in the axial direction of the nozzle needle 60, and is arranged at a side of the pressure control chamber 53, opposite to the seat portion 65. The pressure receiving surface 61 partitions off the pressure control chamber 53 together with the opening-wall surface 90 and the control wall surface portion 57, and receives the pressure of the fuel in the pressure control chamber 53. Thus, the displacement of the nozzle needle 60 is controlled by the fuel pressure in the pressure control chamber 53. The spring housing portion 62 is a cylindrical hole, which is coaxial with the nozzle needle 60, and located in the radially central portion of the pressure receiving surface 61. The spring housing portion 62 receives a portion of a spring 76.

The needle sliding portion 63, which is a portion of the circular column-shaped outer peripheral wall of the nozzle needle 60, is located closer to the pressure receiving surface 61 than the control wall surface portion 57. The needle sliding portion 63 is slidably supported by the cylinder sliding surface portion 59, which is configured by the inner peripheral wall of the cylinder 56. The collar member 67 is a ring-shaped member fitted on the outer peripheral wall portion of the nozzle needle 60 and is held by the nozzle needle 60. The needle anchoring portion 68 is arranged at the side of the seat portion 65 relative to the nozzle needle sliding portion 63 in the axial direction, and is a step portion configured by enlarging an outer diameter of the nozzle needle 60. The needle anchoring portion 68 configures a surface, which faces the needle stopper portion 58*b* of the cylinder 56 in the axial displacement direction of the nozzle needle 60. The needle anchoring portion 68 is locked to the needle stopper portion 58*b*, so that the displacement of the nozzle needle 60 toward the floating plate 70 is limited.

The nozzle needle 60 is biased to a side of the valve portion 50 by a return spring 66. The return spring 66 is a coil spring made by winding a metal wire in the shape of a circle. The return spring 66 has one end in the axial direction seated on a face on the pressure control chamber 53 side of the collar member 67 and has the other end seated on an end surface on the valve portion side of the cylinder 56, respectively. According to the construction described above, the nozzle needle 60 is reciprocally displaced in a linear manner in the axial direction of the cylinder 56 with respect to the cylinder 56 in response to the pressure applied to the pressure receiving surface 61, that is, the pressure of the fuel in the pressure control chamber 53 to seat the seat portion 65 on the valve seat portion 45 or to separate the seat portion 65 from the valve seat portion 45, thereby closing or opening the valve portion 50.

The floating plate 70, which is made of a metal material and configured into a circular disk body, presses the opening-wall surface 90, so as to block the inflow channel 52. The floating plate 70 has a pressing surface 73, a pressure receiving surface 77, a plate anchoring portion 78, an outer peripheral wall surface portion 74, and a communication hole 71. The floating plate 70 is slidably disposed for reciprocating movement in the axial direction of the cylinder 56 of the control body 40 within the pressure control chamber 53. The floating plate 70 has its displacement axis direction arranged along the axial direction of the nozzle needle 60. Of both end surfaces in a displacement axis direction of the floating plate 70, the end surface opposed to the opening-wall surface 90 in the displacement axis direction forms the pressing surface portion 73. The pressing surface portion 73, which has a circular shape, abuts on the opening-wall surface 90 by reciprocating movement of the floating plate 70. The end surface of the floating plate 70, which is opposite from the pressing surface 73 in the displacement axis direction, forms the pressure receiving surface 77, which is opposed to the pressure receiving surface 61 in the displacement axis direction. The pressure receiving surface 77 is pressed toward the opening-wall surface 90 by the pressurized fuel in the pressure control chamber 53.

In addition, the outer peripheral edge of the pressure receiving surface 77 has the plate anchoring portion 78, which is opposed to the plate stopper portion 58*a* of the cylinder 56 in the displacement axial direction. The plate anchoring portion 78 is locked to the plate stopper portion 58*a*, so that the displacement of the floating plate 70 toward the nozzle needle 60 is limited.

The outer peripheral wall surface portion 74 of the floating plate 70, which connects the pressing surface 73 to the pressure receiving surface 77, is opposed to the control wall surface portion 57 in the radial direction of the cylinder 56. Additionally, an inflow chamber 53*a* is a space that is positioned at a side of the inflow channel 52 relative to the floating plate 70 in the pressure control chamber 53. Furthermore, a back pressure chamber 53*b* is a space that is positioned at a side of the nozzle needle 60 relative to the floating plate 70 in the pressure control chamber 53.

The communication hole 71 extends from the radially central portion of the pressure receiving surface 77 to the outflow port 54*a* in the floating plate 70. The extending direction of the communication hole 71 is along the displacement axis direction of the floating plate 70. One end of the communication hole 71 is opened at the radially central portion of the pressing surface 73, which is opposed to the outflow port 54*a*. The pressure control chamber 53 communicates with the outflow port 54*a* by way of the communication hole 71 in a state where the pressing surface 73 of the floating plate 70 abuts on the opening-wall surface 90.

The communication hole 71 has a narrowed portion 71*a* and a recess portion 72. A smallest channel area of the communication hole 71 is defined by the size of the narrowed portion 71*a*, so that the narrowed portion 71*a* controls the flow volume of the fuel flowing through the communication hole 71. The channel area of the narrowed portion 71*a* is configured smaller than the opening area of the outflow port 54*a*. The narrowed portion 71*a* is located closer to an end surface, which is one of both end surfaces of the floating plate 70 in the axial direction thereof and forms the pressing surface 73, than the other end surface forming the pressure receiving surface 77. The recess portion 72, which is coaxial with the floating plate 70 and is cylindrical hole, is recessed from the pressure receiving surface 77 to a side opposite from the pressure receiving surface 61, so that the channel area of the communication hole 71 is partially enlarged by the recess portion 72. The opening of the communication hole 71 in the pressure receiving surface 77 is enlarged by the recess portion 72. On the other hand, the pressure receiving surface 77 is biased by the spring 76 in the displacement axial direction.

The spring 76 is a coil spring made by winding a metal wire in the shape of a circle. The spring 76 has one end in the axial direction seated on the pressure receiving surface 77 of the floating plate 70. The spring 76 has the other end in the axial direction housed in the spring housing portion 62 of the nozzle needle 60. The spring 76 is arranged between the floating plate 70 and the nozzle needle 60 coaxially with them and is arranged in a contracted state in the axial direction.

According to the construction described above, the spring 76 biases the floating plate 70 to the side of the opening-wall surface 90 with respect to the nozzle needle 60. Even when a pressure differential between the inflow chamber 53*a* and the back pressure chamber 53*b* is small, the floating plate 70 is biased to the opening-wall surface 90 by the biasing force of the spring 76, thereby making the pressing surface portion 73 abut on the opening-wall surface 90.

Figure 3:
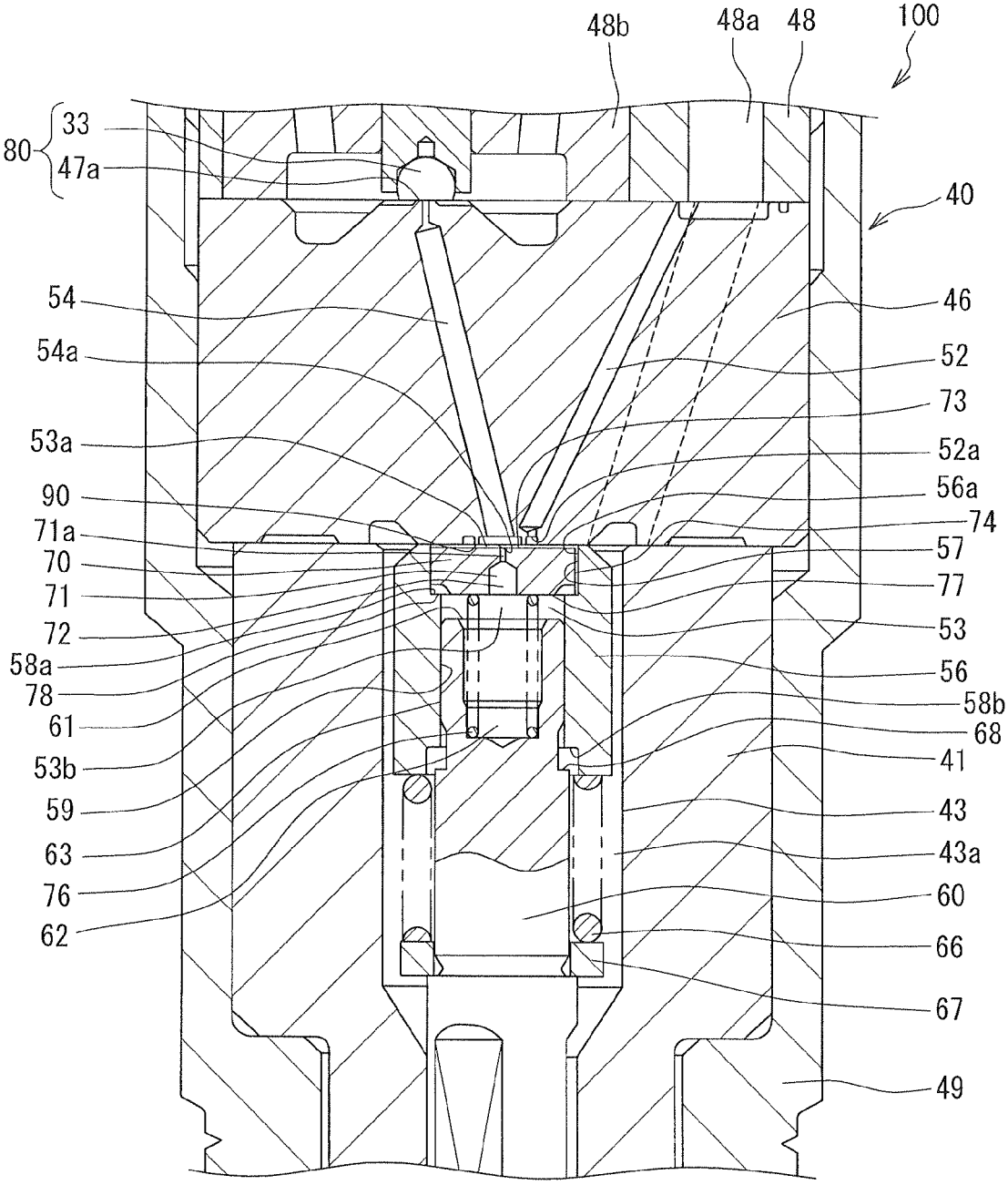
FIG. 3 is a partially enlarged view showing a portion of the fuel injection device according to the first embodiment of the present invention.
Figure 4:
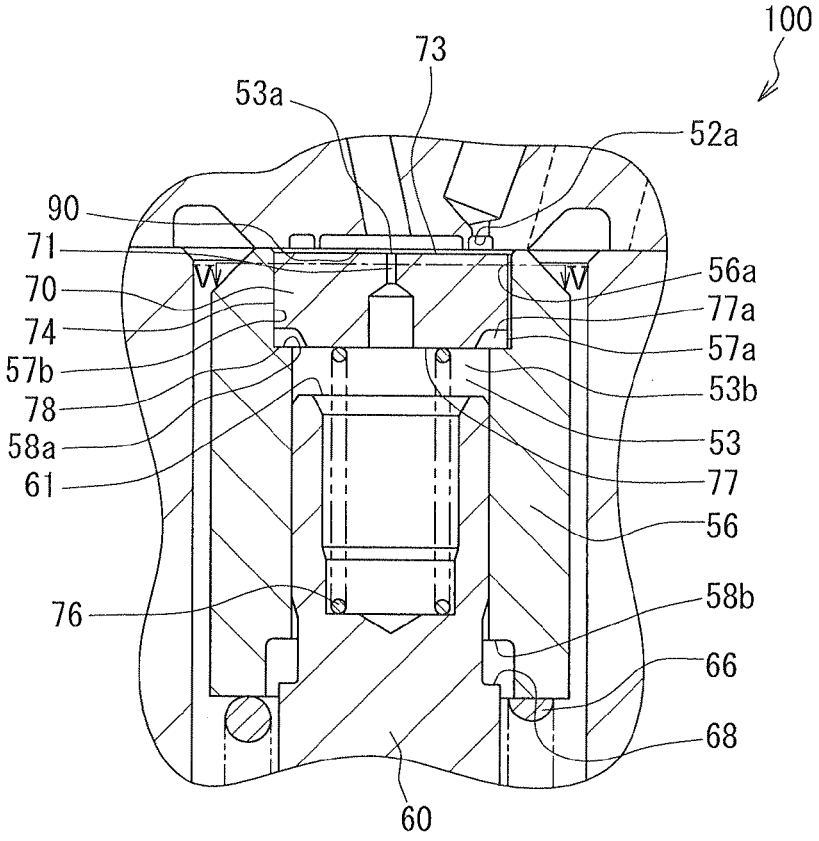
FIG. 4 is a further enlarged sectional view showing the portion of the fuel injection device according to the first embodiment of the present invention.
Figure 5:
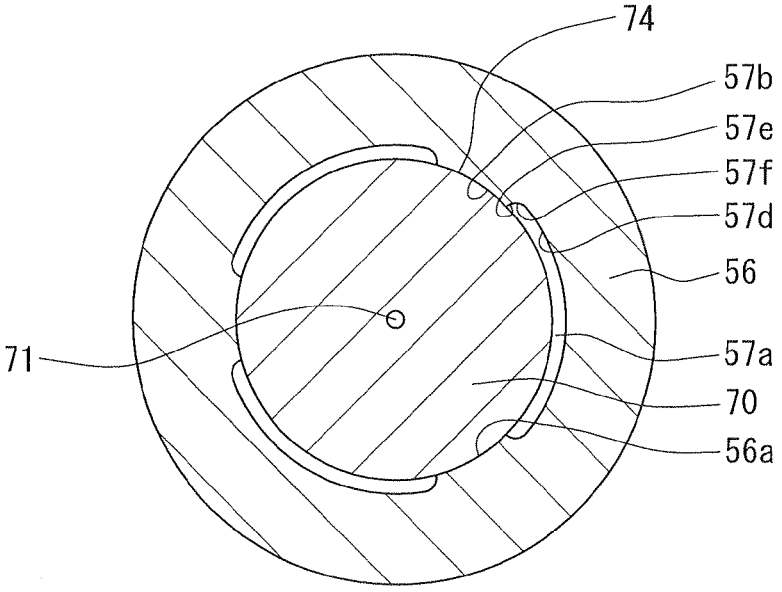
FIG. 5 is a cross-sectional view taken along line V-V in FIG. 4, showing a shape of a communication groove of the first embodiment.

Next, the featured portion of the fuel injection device 100 will be further described in detail on the basis of FIG. 3 and FIG. 5.

A communication groove 57*a* and a slidable contact wall surface 57*b* are arranged in the inner wall surface portion 56*a* of the cylinder 56. The communication groove 57*a* is extended from an axial end of the cylinder 56, which is the side of the opening-wall surface 90 in the axial direction of the cylinder 56, to the plate stopper portion 58*a* along the axial direction of the cylinder 56, so that the communication groove 57*a* causes the inflow chamber 53*a* to communicate with the back pressure chamber 53*b*. A plurality of the communication grooves 57*a* are provided in the inner wall surface portion 56*a* and are spaced from each other in a circumferential direction thereof by a predetermined distance. Specifically, in the first embodiment, three communication grooves 57*a* are provided in the inner wall surface portion 56*a* and are equally spaced from each other in the circumferential direction thereof. The communication groove 57*a* has an arcuate cross section along the circumferential direction of the cylinder 56, and a central angle of the arcuate shape of the communication groove 57*a* is approximately 90 degrees.

The communication groove 57*a* is defined by a bottom portion 57*d*, which is provided along the circumferential direction of the cylinder 56, and a side portion 57*e*, which is provided along the radial direction of the cylinder 56. In the radial-cross section of the cylinder 56, a corner portion 57*f*, which connects the bottom portion 57*d* and the side portion 57*e*, is formed in a circular arc shape. As described above, by forming the corner portion 57*f* in the arcuate shape, the force, which is applied to the inner wall surface portion 56*a* by the pressurized fuel flowing through the communication groove 57*a*, is prevented from concentrating on the corner portion 57*f*.

The slidable contact wall surface 57*b* is arranged between the communication grooves 57*a*, which is adjacent to the slidable contact wall surface 57*b* in the circumferential direction of the cylinder 56. The slidable contact wall surface 57*b* slidably contacts the outer peripheral wall surface portion 74 around the displacement axis of the floating plate 70. The communication groove 57*a* are equally spaced from each other in the circumferential direction, so that three slidable contact wall surfaces 57*b* are also arranged and equally spaced from each other in the circumferential direction of the cylinder 56. Therefore, each of the contact portions between the slidable contact wall surface 57*b* and the outer peripheral wall surface portion 74 are spaced from each other by approximately 120 degrees, so that the floating plate 70 is held by the slidable contact wall surface 57*b* in a direction radially inside of the floating plate 70.

In addition, even between the slidable contact wall surface 57*b* and the outer peripheral wall surface portion 74, a little fuel flow such as very small fuel leakage may occurs. However, when designing a total of a channel area through which the fuel flows from the inflow chamber 53*a* to the back pressure chamber 53*b*, the total of the channel area for obtaining a necessary flow is defined without considering the volume of the fuel that passes between the slidable contact wall surface 57*b* and the outer peripheral wall surface portion 74 and flows into the back pressure chamber 53*b*. Thus, the channel area of the communication groove 57*a*, the radial groove 77*a* that extends in radial direction, and the communication hole 71 are defined, such that the necessary fuel flow amount, which flows from the inflow chamber 53*a* to the back pressure chamber 53*b*, is set by making three communication grooves 57*a* and the three radial grooves 77*a* to communicate with the communication hole 71. Further, a total of the channel areas of the three communication grooves 57*a* and the communication hole 71 is set to be larger than the opening area of the inflow port 52*a*.

In addition, the plate anchoring portion 78 of the floating plate 70 is provided with the multiple radial grooves 77*a*. The multiple radial grooves 77*a* are spaced from each other in the circumferential direction. The radial groove 77*a* extends in the radial direction of the floating plate 70. The radial groove 77*a* forms a passage, through which the fuel can flow, between the plate anchoring portion 78 and the plate stopper portion 58*a*.

Next, operation of the fuel injection device 100, which controls opening/closing of the valve portion 50 and injects a fuel by a control signal output from the engine control device 17, will be described below on the basis of FIG. 2 to FIG. 5.

In a state where the pressure control valve 80 blocks the outflow port 54*a* and the return channel 14*f* (see FIG. 1), the pressing surface 73 of the floating plate 70 abuts on the opening-wall surface 90 by the biasing force of the spring 76 toward the closed position of the inflow channel 52. When the outflow port 54*a* communicates with the return channel 14*f* by the operation of the pressure control valve 80, the fuel in the pressure control chamber 53 starts to outflow through the outflow channel 54. This creates decompression at a place adjacent to the outflow port 54*a*, so that the floating plate 70 is attracted toward the opening-wall surface 90, the pressing surface 73 presses the opening-wall surface 90, and the inflow port 52*a* is blocked.

The fuel in the back pressure chamber 53*b* of the pressure control chamber 53 flows out of the outflow port 54*a* through the communication hole 71. If the flow from the outflow port 54*a* continues, the fuel pressure in the pressure control chamber 53 is decreased. When the fuel pressure in the pressure control chamber 53 becomes lower than a predetermined pressure value, the nozzle needle 60 is moved toward a side of the pressure control chamber 53, so that the seat portion 65 is separated from the valve seat portion 45, thereby opens the valve portion 50. (In the following description, the pressure, at the time at which the nozzle needle 60 starts to move, will be simply referred to as the predetermined pressure.) Thereafter, the movement of the nozzle needle 60 toward the side of the pressure control chamber 53 is limited by the abutting of the needle anchoring portion 68 on the needle stopper portion 58*b*.

When the communication between the outflow port 54*a* and the return channel 14*f* (see FIG. 1) is interrupted by closing the pressure control valve 80, the floating plate 70 is pressed toward the side of the nozzle needle 60 by the high-pressure fuel introduced through the inflow channel 52. When the force generated by the high-pressure fuel in the inflow channel 52, which acts toward the side of the nozzle needle 60, becomes higher than the biasing force of the spring 76, which acts toward the side of the opening-wall surface 90, the floating plate 70 starts to displace. The separating of the floating plate 70 from the opening-wall surface 90 results in the communication between the inflow channel 52 and the pressure control chamber 53. Thereby, the high-pressure fuel is introduced into the inflow chamber 53*a*. The displacement of the floating plate 70 toward the side of the nozzle needle 60 is limited by the abutting of the plate anchoring portion 78 on the plate stopper portion 58*a*.

Then, the fuel, which is introduced from the inflow channel 52 into the inflow chamber 53*a*, flows to the back pressure chamber 53*b* through the three communication grooves 57*a* and the three radial grooves 77*a* that are arranged on the inner wall surface portion 56*a* of the cylinder 56, and the communication hole 71. By the pressure recovery in the back pressure chamber 53*b*, the nozzle needle 60 is pressed down toward the side of the valve portion 50. Thus, the nozzle needle 60 causes the seat portion 65 to be seated on the valve seat portion 45 and blocks the injection hole 44.

Even after the valve portion 50 is closed, the fuel flow from the inflow chamber 53*a* to the back pressure chamber 53*b* continues. Thus, the pressure differential between the inflow chamber 53*a* and the back pressure chamber 53*b* within the pressure control chamber 53 is progressively reduced. Therefore, the biasing force of the spring 76 becomes larger than the force of the floating plate 70 acting toward the side of the nozzle needle 60, so that the floating plate 70 causes the plate anchoring portion 78 to separate from the plate stopper portion 58*a* and resumes to displace toward the side of the opening-wall surface 90. Then, the floating plate 70 returns to the state where the pressing surface 73 abuts on the opening-wall surface 90 by the biasing force of the spring 76.

In the first embodiment, the sufficient channel area for allowing the fuel to flow from the inflow channel 53*a* to the back pressure chamber 53*b* is provided by the communication grooves 57*a*. Thus, the pressure recovery in the back pressure chamber 53*b* is generally not limited due to the floating plate 70.

On the other hand, due to the providing of the sufficient channel area by the communication grooves 57*a*, the clearance between the inner wall surface portion 56*a* of the cylinder 56 and the outer peripheral wall surface portion 74 of the floating plate 70 can be reduced. By the reduction of the clearance, an occurrence of an event where the displacement axis of the floating plate 70 inclines relative to the axial direction of the cylinder 56 can be limited. Thus, the floating plate 70 is smoothly slidable and can displace within the pressure control chamber 53. Thereby, the floating plate 70 allows the inflow channel 52 to open quickly into the pressure control chamber 53. Therefore, an introduction of the fuel into the pressure control chamber 53 is not limited by the floating plate.

Thus, when the floating plate 70 opens the inflow channel 52, the fuel is introduced quickly into the inflow chamber 53*a*, and furthermore, the fuel may smoothly flow into the back pressure chamber 53*b*. Thereby, a time, which is needed for pressure recovery by the starting time of the displacement of the nozzle needle 60, may be shortened. Therefore, in the fuel injection device 100, a response of the nozzle needle 60 at valve closing time can be improved.

In addition, in the first embodiment, the sufficient channel area of the passage for communicating the inflow channel 53*a* with the back pressure chamber 53*b* is provided by the communication groove 57*a*. Thus, even if the slidable contact wall surface 57*b*, which slidably contacts the outer peripheral wall surface portion 74 of the floating plate 70, is arranged on the inner wall surface portion 56*a* of the cylinder 56, it can prevent the pressure recovery in the back pressure chamber 53*b* from being interrupted by the floating plate 70. The floating plate 70 is displaced and reciprocated on the slidable contact wall surface 57*b*, so that an inclination of the axis of the floating plate 70 can be limited. Thus, the floating plate 70 can accurately displace and reciprocate in the pressure control chamber 53, so that the high-pressure fuel introduction into the inflow channel 53*a* is not interrupted. Therefore, a time period needed for the pressure recovery in the back pressure chamber 53*b* is accurately shortened, so that the response of the nozzle needle 60 at the valve closing time can be more effectively improved.

In the first embodiment, high pressure of the high-pressure fuel acts on the communication groove 57*a*, through which the high-pressure fuel flows. In the radial cross-section of the communication groove 57*a*, the corner portion 57*f* between the bottom portion 57*d* and the side portion 57*e* of the communication groove 57*a* is formed in the circular arc shape, so that it can prevent the stress from being collected at the corner 57*f*. In addition, the communication groove 57*a* is configured in an arcuate shape and extended in the circumferential direction, so that the sufficient channel area described above can be provided, and the communication groove 57*a* having a shallow depth in the radial direction can be formed. Thus, it is easy to provide a sufficient wall thickness of the cylinder 56 in the radial direction, so that deterioration of strength of the cylinder 56 can be limited. Thus, deterioration of the cylinder 56 caused by providing the communication groove 57*a* can be limited. Therefore, the response of the nozzle needle 60 at the valve closing time can be improved in the fuel injection device 100, while high endurance of the fuel injection device 100 can be achieved.

In the first embodiment, the three communication grooves 57*a* are arranged separately from each other in the circumferential direction, so that the channel area of the passage, through which the fuel flows from the inflow chamber 53*a* into the back pressure chamber 53*b*, can be easily enlarged. Thus, this allows a large volume of fuel to flow toward the back pressure chamber 53*b*, so that the pressure recovery in the back pressure chamber 53*b* can be quickly achieved. In addition, the three communication grooves 57*a* are arranged and spaced at equal intervals in the circumferential direction of the cylinder 56, so that the fuel flows into the back pressure chamber 53*b* from the three portions. Thus, the fuel flow around the floating plate 70 can become in uniform.

The providing the three communication grooves 57*a* results in the increase of the flow amount of the fuel flowing into the back pressure chamber 53*b*, and the even fuel flow is achieved by arranging the communication grooves 57*a* at equal intervals, so that the inclination of the floating plate 70 relative to the axial direction thereof may be limited. Thereby, the pressure recovery in the back pressure chamber 53*b* is achieved quickly and smoothly. Thus, movement start time of the nozzle needle 60 is brought forward, and the fluctuation of the movement start time may be small. Therefore, the response of the nozzle needle 60 at the valve closing time can be improved in the fuel injection device 100.

In addition, in the first embodiment, the configuration of the communication groove 57*a* extending in the axial direction of the cylinder 56 can reduce the resistance of the flow through the communication groove 56*a*. Thus, the flow of the fuel flowing from the inflow chamber 53*a* to the back pressure chamber 53*b* can be made more smoothly. Therefore, the time period needed for the pressure recovery in the back pressure chamber 53*b* can be more shortened, so that the response of the nozzle needle 60 at the valve closing time can be more effectively improved.

In addition, in the first embodiment, the plate stopper portion 58*a*, which has the stepped portion, is arranged in the cylinder 56 of the control body 40, so that the displacement of the floating plate 70 in the direction separating from the inflow channel 52 is accurately limited with a simple structure. Thereby, at the time of closing the nozzle needle 60, the floating plate 70 closes the inflow channel 52 quickly and stops introducing the high-pressure fuel into the pressure control chamber 53. However, between the plate anchoring portion 78 and the plate stopper portion 58*a*, the fuel flow from the inflow chamber 53*a* to the back pressure chamber 53*b* may be limited. In the present embodiment, the radial groove 77*a* is arranged in the plate anchoring portion 78, so that even when the plate anchoring portion 78 and the plate stopper portion 58*a* are in contact with each other, the fuel can flow. Thus, the function of the communication groove 57*a*, by which the time needed for the pressure recovery in the back pressure chamber 53*b* can be shortened, is effectively exerted, without interruption by the contact of the plate anchoring portion 78 and the plate stopper portion 58*a*. Therefore, the response of the nozzle needle 60 both at the valve closing time and at the valve opening time may be improved in the fuel injection device 100.

In the first embodiment, the diesel engine 20 is an example of an internal combustion engine described in claims, the control body 40 is an example of a valve body described in claims, the nozzle body 41 is an example of a nozzle member described in claims, the cylinder 56 is an example of a cylindrical member described in claims, the inner wall surface portion 56*a* is an example of a cylindrical inner wall portion in claims, the nozzle needle 60 is an example of a valve member in claims, and the floating plate 70 is an example of a control member in claims.

(Second Embodiment)

Figure 6:
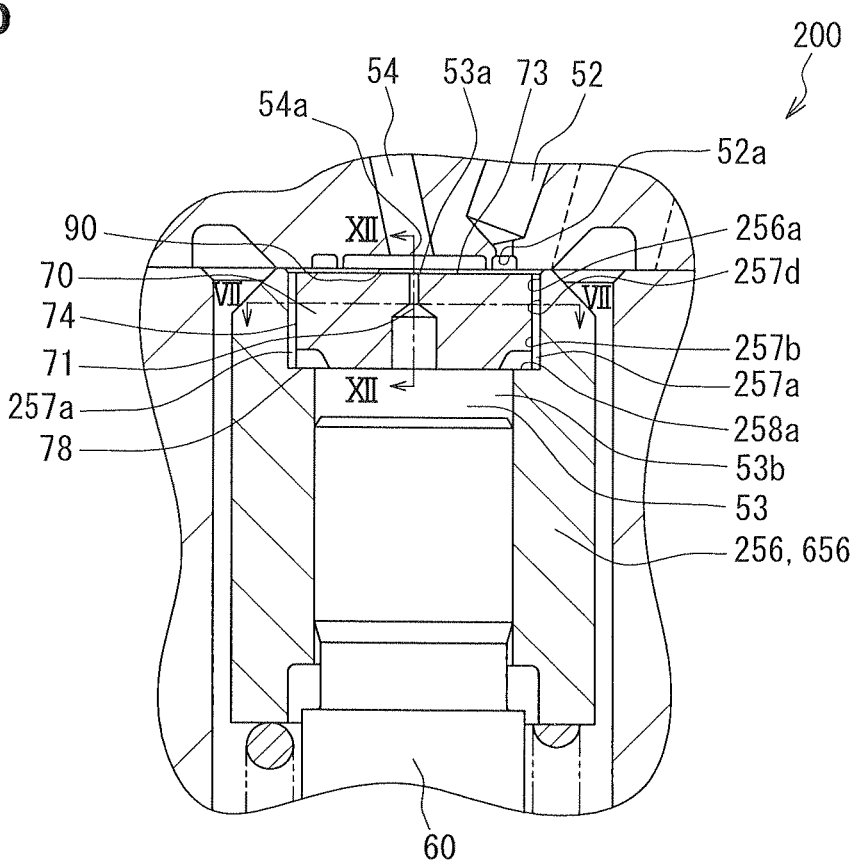
FIG. 6 is a partially enlarged view showing a part of a fuel injection device according to a second embodiment of the present invention, which is a modification example of FIG. 4.
Figure 7:
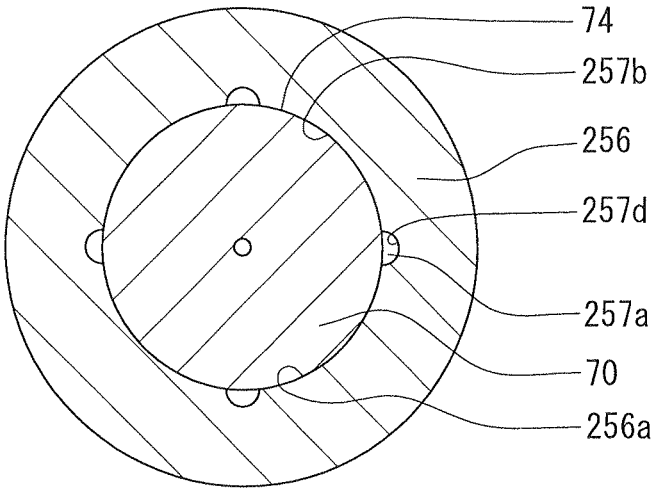
FIG. 7 a cross-sectional view taken along line VII-VII in FIG. 6, showing a modification example of FIG. 5.

A second embodiment of the present invention shown in FIGS. 6 and 7 is a modified example of the above-described first embodiment. In a fuel injection device 200 of the second embodiment, a cylinder 256 corresponding to the cylinder 56 (see FIG. 3) in the first embodiment is arranged. In addition, in the fuel injection device 200, a construction corresponding to the spring 76 (see FIG. 3) in the first embodiment is omitted. Next, the detail structure of the fuel injection device 200 according to the second embodiment will be described.

A communication groove 257*a* and a slidable contact wall surface 257*b* are arranged in an inner wall surface portion 256*a* of the cylinder 256. The communication groove 257*a* and the slidable contact wall surface 257*b* correspond to the communication groove 57*a* and the slidable contact wall surface 57*b* (see FIG. 4) respectively that are arranged in the cylinder 56 of the first embodiment.

The communication groove 257*a* connecting the inflow chamber 53*a* to the back pressure chamber 53*b* extends from an end of the cylinder 256 on the side of the opening-wall surface 90 to a plate stopper portion 258*a* along the axial direction of the cylinder 256. In the second embodiment, the four communication grooves 257*a* are provided and equally spaced from each other in the circumferential direction of the cylinder 256. The communication groove 257*a* has a semi-circular shape in its radial cross sectional. As described above, making a bottom portion 257*d* of the communication groove 257*a* into the circular arc shape in the cross section perpendicular to the axial direction results in a less concentration of force applied by the high-pressurized fuel flowing through the communication groove 257*a*.

The slidable contact wall surface 257*b*, which slidably contacts the outer peripheral wall surface portion 74 of the floating plate 70, is arranged between the communication groves 257*a*, which are adjoining each other, in the circumferential direction of the cylinder 256. The slidable contact wall surface 257*b* contacts the outer peripheral wall surface portion 74, so that the floating plate 70 is held by the slidable contact wall surface 257*b* in the radially inside direction of the floating plate 70. In addition, likewise the first embodiment, even between the slidable contact wall surface 257*b* and the outer peripheral wall surface portion 74, a little fuel, such as very small fuel leakage, may flow.

Next, the operation for opening and closing the valve portion 50 in the above-described fuel injection device 200 will be described with reference to FIGS. 2, 6 and 7.

Before the outflow port 54*a* communicates with the return channel 14*f* by the operation of the pressure control valve 80, the plate anchoring portion 78 of the floating plate 70 is seated on the plate stopper portion 258*a*. When the operation of the pressure control valve 80 makes the outflow port 54*a* communicate with the return channel 14*f* (see FIG. 1), the fuel flows out of the pressure control chamber 53 through the outflow channel 54. This creates decompression at the vicinity of the outflow port 54*a*, so that the floating plate 70 is attracted toward the opening-wall surface 90, thereby, the pressing surface 73 presses the opening-wall surface 90, and this makes the inflow port 52*a* blocked. Therefore, likewise the first embodiment, when the pressure in the pressure control chamber 53 becomes lower than the predetermined pressure value, the nozzle needle 60 opens the valve portion 50.

The floating plate 70 abutting on the opening-wall surface 90 presses the opening-wall surface 90, thereby blocking the inflow port 52*a*. Due to the outflow of the fuel flowing through the communication hole 71, rapid decompression of the pressure occurs in the pressure control chamber 53, in which the fuel flow from the inflow port 52*a* is interrupted. By the decompression of the pressure in the pressure control chamber 53, the nozzle needle 60 is pressed up toward the side of the pressure control chamber 53, so that the seat portion 65 separates from the valve portion 45, thereby keeping the valve portion 50 in an opening state.

When the communication between the outflow port 54*a* and the return channel 14*f* (see FIG. 1) is interrupted by closing the pressure control valve 80, the floating plate 70 is pressed toward the side of the nozzle needle 60 by the high-pressure fuel introduced through the inflow channel 52, so that the floating plate 70 starts moving. The detachment of the floating plate 70 from the opening-wall surface 90 results in opening of the inflow channel 52 into the pressure control chamber 53. Thereby, the high-pressure fuel is introduced into the inflow chamber 53*a*.

Then, the fuel introduced from the inflow channel 52 into the inflow chamber 53*a* flows toward the back pressure chamber 53*b*, through the four communication grooves 257*a*, which are arranged on the inner wall surface portion 256*a* of the cylinder 256, and the four communication holes 71. By the pressure recovery in the back pressure chamber 53*b*, the nozzle needle 60 is pressed down toward the side of the valve portion 50. The nozzle needle 60 causes the seat portion 65 to be seated on the valve seat portion 45, so as to block the injection hole 44. In the second embodiment, unlike the first embodiment, the floating plate 70 remains in detaching from the opening-wall surface 90 until the outflow port 54*a* is made communicate with the return channel 14*f* (see FIG. 1) by the pressure control valve 80.

In the second embodiment, the sufficient channel area for allowing the fuel to flow from the inflow channel 53*a* to the back pressure chamber 53*b* is ensured by the communication groove 257*a*. Thus, it can prevent the pressure recovery in the back pressure chamber 53*b* from being interrupted by the floating plate 70.

In addition, the slidable contact wall surface 257*b* slidably contacts the outer peripheral wall surface portion 74 of the floating plate 70, so that the displacement axis of the floating plate 70 is less likely inclined relative to the axial direction of the cylinder 256. Therefore, the floating plate 70 can smoothly displace within the pressure control chamber 53, and thereby it is possible to open quickly the inflow channel 52 into the pressure control chamber 53. Thus, it can prevent the fuel flow introduced into the pressure control chamber 53 from being restricted by the floating plate 70.

Thus, the fuel is introduced quickly into the inflow chamber 53*a*, and furthermore, the fuel can smoothly flow into the back pressure chamber 53*b*. Thereby, the time period taken for the pressure recovery by the initial displacement of the nozzle needle 60 can be shortened. Therefore, in the fuel injection device 200, the response of the nozzle needle 60 at valve closing time can be improved.

In addition, in the second embodiment, the bottom portion 257*d* of the communication groove 257, to which the pressure of the high-pressurized fuel is applied, is configured in the circular arc shape, so that the stress may not be collected at the vicinity of the bottom portion 257*d*. Thus, it can prevent deterioration of the cylinder 256 caused by providing the communication groove 257*a*. In addition, by the distribution of stresses, the depth of the communication groove 257*a* in the radial direction of the cylinder 256 can be made larger. Therefore, the width of the communication groove 257 in the circumferential direction can be narrowed, while the sufficient channel area is ensured. Thus, the width of the slidable contact wall surface 257*b*, which is arranged between the communication grooves 257 adjoining each other, can be enlarged in the circumferential direction. Hence, the superficial area of the outer peripheral wall surface portion 74, which contacts the slidable contact wall surface 257*b*, becomes greater, and thereby the inclination of the floating plate 70 relative to the axial direction will less likely occur. Therefore, the response of the nozzle needle 60 at the valve closing time can be improved in the fuel injection device 200, while high endurance of the fuel injection device 200 is ensured.

In the second embodiment, the cylinder 256 is an example of a cylindrical member described in claims, and the inner wall surface portion 256*a* is an example of a cylindrical inner wall portion described in claims.

(Third Embodiment)

Figure 8:
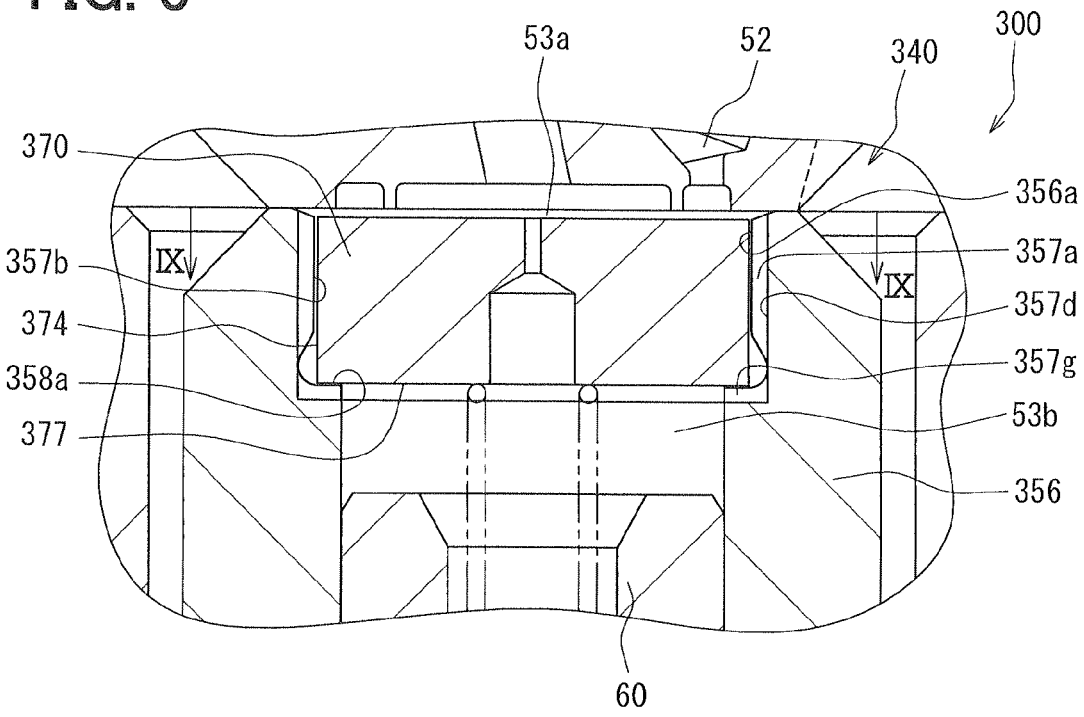
FIG. 8 is a partially enlarged view showing a portion of a fuel injection device according to a third embodiment of the present invention and a cross-sectional view taken along line VIII-VIII in FIG. 9 where a floating plate is held within a cylinder.
Figure 9:
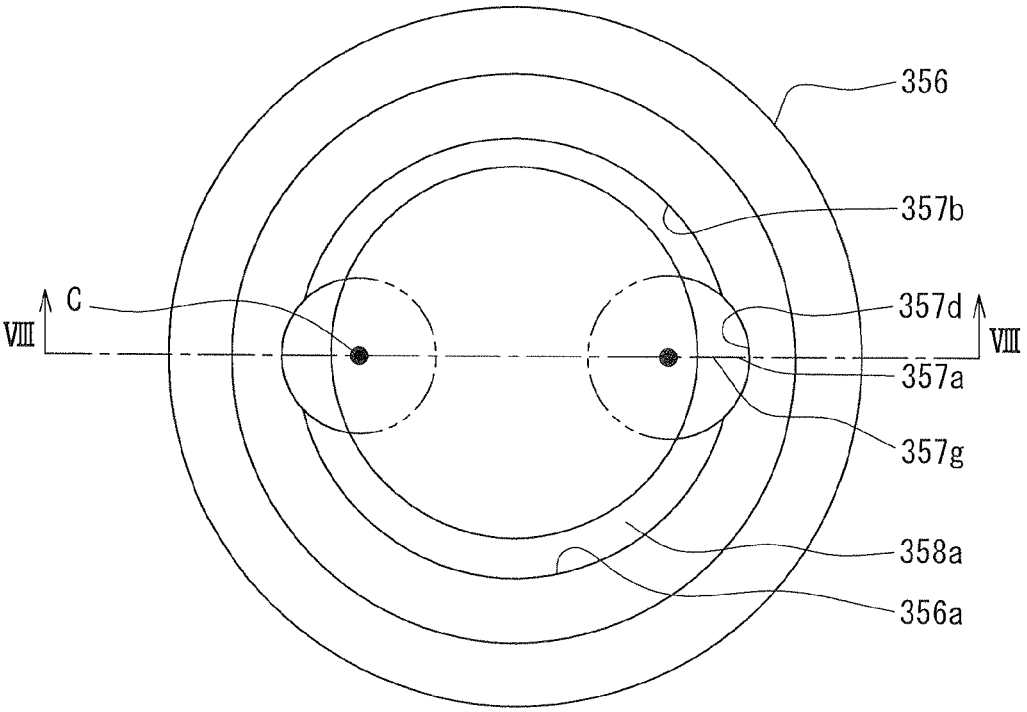
FIG. 9 is a cross-sectional view taken along line IX-IX in FIG. 8, showing a structure of a communication groove and a sub-communication groove of the third embodiment of the present invention.

A third embodiment of the present invention shown in FIGS. 8 and 9 is another modified example of the above-described first embodiment. A control body 340 of a fuel injection device 300 in the third embodiment has a cylinder 356 corresponding to the cylinder 56 (see FIG. 3) in the first embodiment. Furthermore, the fuel injection device 300 of the third embodiment includes a floating plate 370 corresponding to the floating plate 70 in the first embodiment.

Hereinafter, the construction of the fuel injection device 300 according to the third embodiment will be described in detail based on FIGS. 8 and 9.

An inner wall surface portion 356*a* of the cylinder 356 is provided with a communication groove 357*a*, a slidable contact wall surface 357*b*, a plate stopper portion 358*a*, and a sub-communication groove 357*g*. Likewise the communication groove 257*a* (see FIG. 6) in the second embodiment, the communication groove 357*a* extends along the axial direction of the cylinder 356, thereby connecting the inflow chamber 53*a* to the back pressure chamber 53*b*. A pair of the communication grooves 357*a* are provided on the inner wall surface portion 356*a*. The communication grooves 357*a* are arranged and spaced from each other by 180 degrees in the circumferential direction of the cylinder 356. In a radial cross-section perpendicular to the axial direction of the cylinder 356, a bottom portion 357*d* of the communication groove 357*a* has a circular arc shape. The slidable contact wall surface 357*b* is arranged between the communication groves 357*a*, which are adjoining each other, and slidably contacts an outer peripheral wall surface portion 374 of the floating plate 370.

The plate stopper portion 358*a* has a stepped shape protruding toward a radially inside of the inner wall surface portion 356*a*, and is opposed to a pressure receiving surface 377, which is an end surface of the floating plate 370 on the side of the back pressure chamber 53*b*. The plate stopper portion 358*a* is made to be in contact with the pressure receiving surface 377 of the floating plate 370 by the displacement of the floating plate 370 separating from the inflow channel 52, so that the plate stopper portion 358*a* limits the displacement of the floating plate 370. The two sub-communication grooves 357*g* are provided at the plate stopper portion 358*a*.

The two sub-communication grooves 357*g* are connected to the two communication grooves 357*a* respectively. Therefore, each communication groove 357*a* incorporates with each sub-communication groove 357*g* to connect the inflow chamber 53*a* to the back pressure chamber 53*b*. Each sub-communication groove 357*g* is arranged and spaced from each other by 180 degrees in the circumferential direction of the cylinder 356. In a radial cross-section perpendicular to the axial direction of the cylinder 356, the sub-communication groove 357*g* has a circular arc shape. The sub-communication groove 357*g* and the bottom portion 357*d* of the communication groove 357*a* are coaxial with each other and have a same radius. A center of the circular arc shape of the sub-communication groove 357*a* is located inside the plate stopper portion 358*a* in a radial direction of the cylinder 356. Thus, a channel area of the sub-communication groove 357*g* becomes larger in the flow direction from the inflow chamber 53*a* to the back pressure chamber 53*b*, as approaching the downstream side.

As described above, by providing the plate stopper portion 358*a* with the sub-communication groove 357*g*, even when the floating plate 370 and the plate stopper portion 358 are in contact with each other, the fuel can flow between the inflow chamber 53*a* and the back pressure chamber 53*b*. Thus, a configuration corresponding to the radial groove 77*a* (see FIG. 3) can be omitted in the pressure receiving surface 377 of the floating plate 370.

In the third embodiment, the sub-communication groove 357*g* is provided in the plate stopper portion 358*a*, and incorporates with the communication groove 357*a* to connect the inflow chamber 53*a* to the back pressure chamber 53*b*, so that it ensures the fuel flow from the inflow chamber 53*a* into the back pressure chamber 53*b*. Therefore, it prevents the pressure recovery within the back pressure chamber 53*b* from being interrupted by the contact between the pressure receiving surface 377 and the plate stopper portion 358. Thus, the response of the nozzle needle 60 both at the valve closing time and at the valve opening time can be improved in the fuel injection device 300.

In addition, in the third embodiment, the channel area of the sub-communication groove 357*g* becomes larger as approaching the downstream side, so that the pressure of the fuel flowing through the sub-communication groove 357*g* becomes smaller as approaching the fuel downstream side. Thereby, the fuel flowing through the communication groove 357*a* and the sub-communication groove 357*g* is attracted toward the downstream side, so that this allows the fuel to flow more smoothly from the inflow chamber 53*a* into the back pressure chamber 53*b*. Thus, time period taken for the pressure recovery can be shortened, so that the response of the nozzle needle 60 at the valve closing time can be further improved.

In the third embodiment, the multiple communication grooves 357*a* and the multiple sub-communication grooves 357*g* more than two may be provided, thereby allowing the enlargement of the channel area, through which the fuel flows from the inflow chamber 53*a* into the back pressure chamber 53*b*. In addition, by equally spacing the multiple communication grooves 357*a* and multiple sub-communication grooves 357*g* from each other in the circumferential direction of the cylinder 356, the fuel can flow in uniform around the floating plate 370. Thus, the inclination of the floating plate can be restricted. As described above, the channel area is enlarged and the posture of the floating plate 370 is stabilized, so that the pressure recovery in the back pressure chamber 53*b* is achieved quickly and smoothly. Thus, the movement start time of the nozzle needle 60 is brought forward, and the time fluctuation can be small. Therefore, the response of the nozzle needle 60 at the valve closing time can be improved.

In the third embodiment, the radial groove for the communication can be omitted in the floating plate 370, so that the cost for manufacturing the floating plate 370 can be lowered. In addition, in the cross-section of the cylinder 356, the sub-communication groove 357*g* and the communication groove 357*a* are defined by the arcs respectively that are coaxial with each other and have the same radius. Thus, cutting processes for forming the communication groove 357*a* and the sub-communication groove 357*g* in the cylinder 356 can be conducted at the same time with a same tool. Therefore, the forming of the communication groove 357*a* and the sub-communication groove 357*g* at the same time results in the cost reduction on the manufacturing of the cylinder 356. Thereby, the response of the nozzle member both at the valve closing time and at the valve opening time can be improved with lower cost in the fuel injection device 300.

In the third embodiment, the control body 340 is an example of a valve body described in claims, the cylinder 356 is an example of a cylindrical member described in claims, the inner wall surface portion 356*a* is an example of a cylindrical inner wall portion described in claims, and the floating plate 370 is an example of a control member described in claims.

(Fourth Embodiment)

Figure 10:
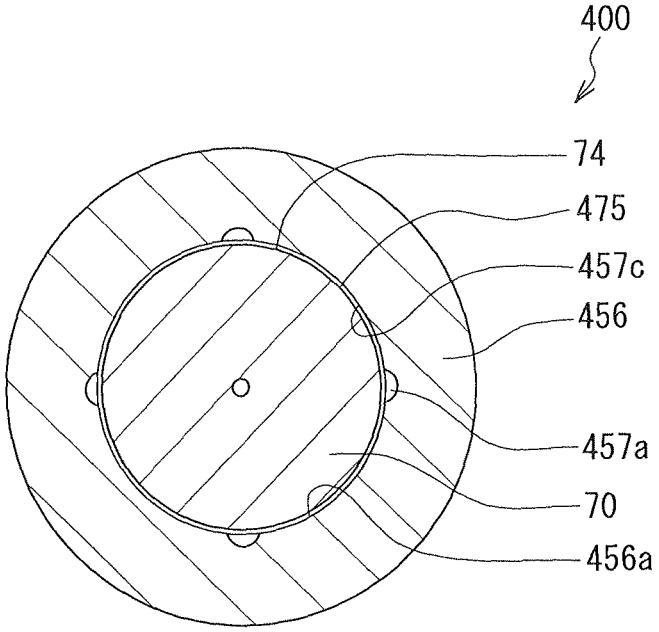
FIG. 10 is a cross-sectional view showing a portion of a fuel injection device according to a fourth embodiment of the present invention, which is a modification example of FIG. 7.

A fourth embodiment shown in FIG. 10 is a modification example of the second embodiment. A fuel injection device 400 of the fourth embodiment includes a cylinder 456 corresponding to the cylinder 256 in the second embodiment. Hereinafter, the construction of the fuel injection device 400 according to the fourth embodiment will be described in detail with reference to FIG. 10 and FIG. 6.

An inner wall surface 456*a* of the cylinder 456 has a communication wall portion 457*c* and four communication grooves 457*a* substantially corresponding to the communication groove 257*a* in the second embodiment. The communication wall portion 457*c* is arranged between the communication groves 457*a*, which are adjoining each other in the circumferential direction of the cylinder 456, and defines a communication clearance 475, which connects the inflow chamber 53*a* to the back pressure chamber 53*b*, between the floating plate 70 and the outer peripheral wall surface portion 74.

In the fourth embodiment, sufficient channel area of the passage connecting the inflow chamber 53*a* and the back pressure chamber 53*b* is ensured by the communication groove 457*a*. Thus, the response of the nozzle needle 60 at the valve closing time can be improved.

In addition, the sufficient channel area is ensured by the communication groove 457*a*, so that the channel area defined by the communication clearance 475 is not necessary to be enlarged. Thus, the depth of the communication clearance 475 can be small, so as to restrict the inclination of the axis of the floating plate 70. On the other hand, even if the channel area of the communication clearance 475 is small, forming the communication clearance 475 results in the enlargement of total channel area of the passage connecting the inflow channel 53*a* and the back pressure chamber 53*b*. Thereby, the amount of the fuel flow from inflow chamber 53*a* into the back pressure chamber 53*b* is increased. Thus, time period taken for the pressure recovery is shortened, so that the response of the nozzle needle 60 at the valve closing time can be further improved.

In the fourth embodiment, the cylinder 456 is an example of a cylindrical member described in claims, and the inner wall surface portion 456*a* is an example of a cylindrical inner wall portion described in claims.

(Fifth Embodiment)

Figure 11:
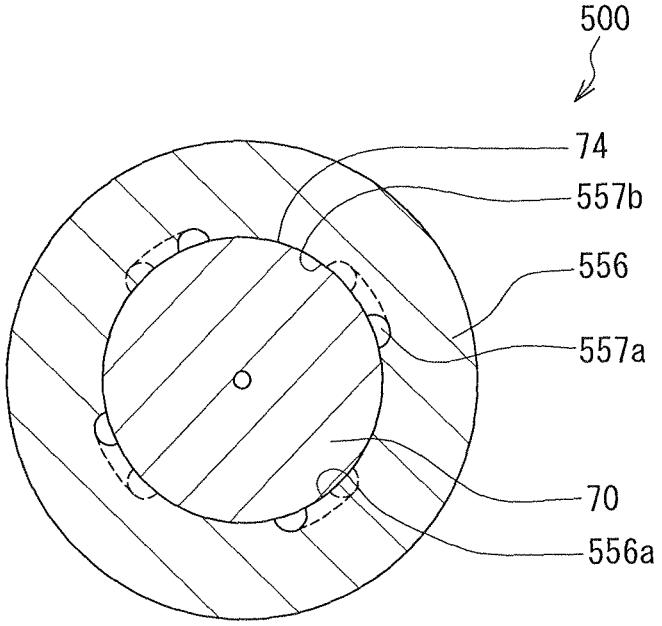
FIG. 11 is a cross-sectional view showing a portion of a fuel injection device according to a fifth embodiment of the present invention, which is another modification example of FIG. 7.

A fifth embodiment shown in FIG. 11 is another modification example of the second embodiment. In a fuel injection device 500 of the fifth embodiment, a cylinder 556 corresponding to the cylinder 256 in the second embodiment is arranged. Hereinafter, the construction of the fuel injection device 500 according to the fifth embodiment will be described in detail with reference to FIG. 6 and FIG. 11.

In an inner wall surface portion 556*a* of a cylinder 556, a communication groove 557*a* and a slidable contact wall surface 557*b*, which correspond to the communication groove 257*a* and the slidable contact wall surface 257*b* in the second embodiment respectively, are arranged. In the fifth embodiment, four communication grooves 557*a* connecting the inflow chamber 53*a* and the back pressure chamber 53*b* are equally spaced from each other in the circumferential direction of the cylinder 556. Each communication groove 557*a* is spirally wound around and extends along the central axis of the cylinder 556. A slidable contact wall surface 557*b* is provided between the spiral communication groves 557*a* and slidably contacts the outer peripheral wall surface portion 74 of the floating plate 70.

In the above-described fifth embodiment, even if the communication groove 557*a* is spirally wound, it is possible for the inflow chamber 53*a* to communicate with the back pressure chamber 53*b* via the communication groove 557*a*, so that the pressure recovery in the back pressure chamber 53*b* can be quickly achieved. Thus, even if the communication groove 57*a* configured on an inner wall surface portion 556*a* of the cylinder 556 is spiral-shaped, the response of the nozzle needle 60 at the valve closing time can be improved.

In the fifth embodiment, the cylinder 556 is an example of a cylindrical member described in claims, and the inner wall surface portion 556*a* is an example of a cylindrical inner wall portion described in claims.

(Sixth and Seventh Embodiment)

Figure 12:
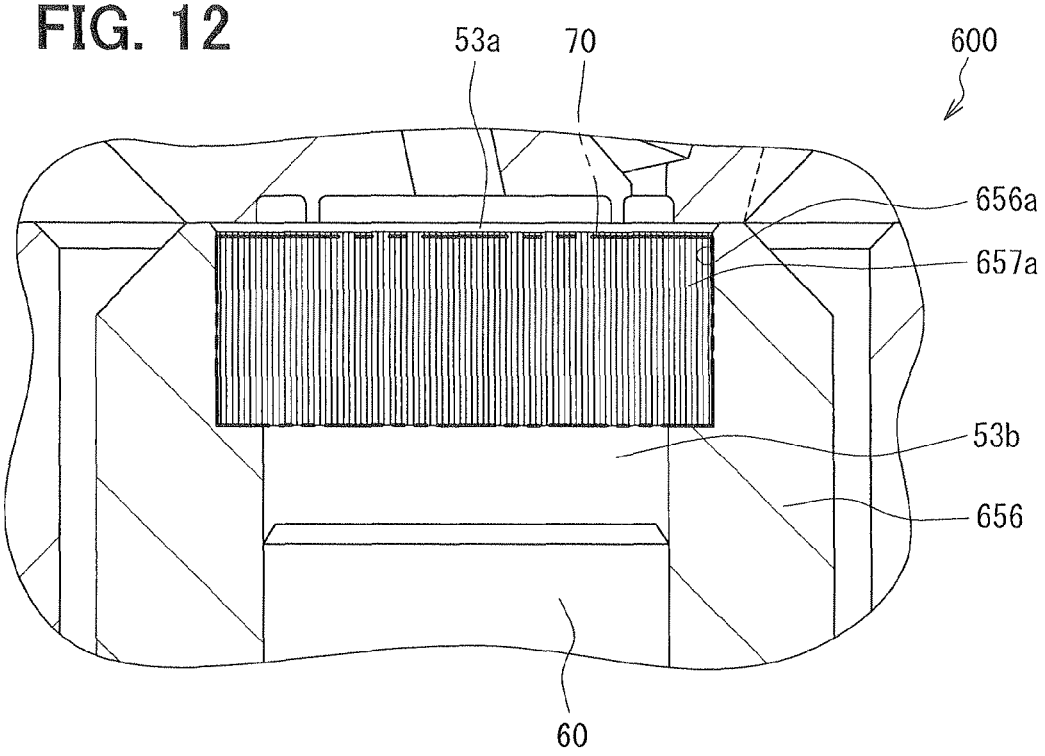
FIG. 12 is a cross-sectional view taken along line XII-XII in FIG. 6 and showing a portion of a fuel injection device for describing a communication groove according to a sixth embodiment of the present invention.
Figure 13:
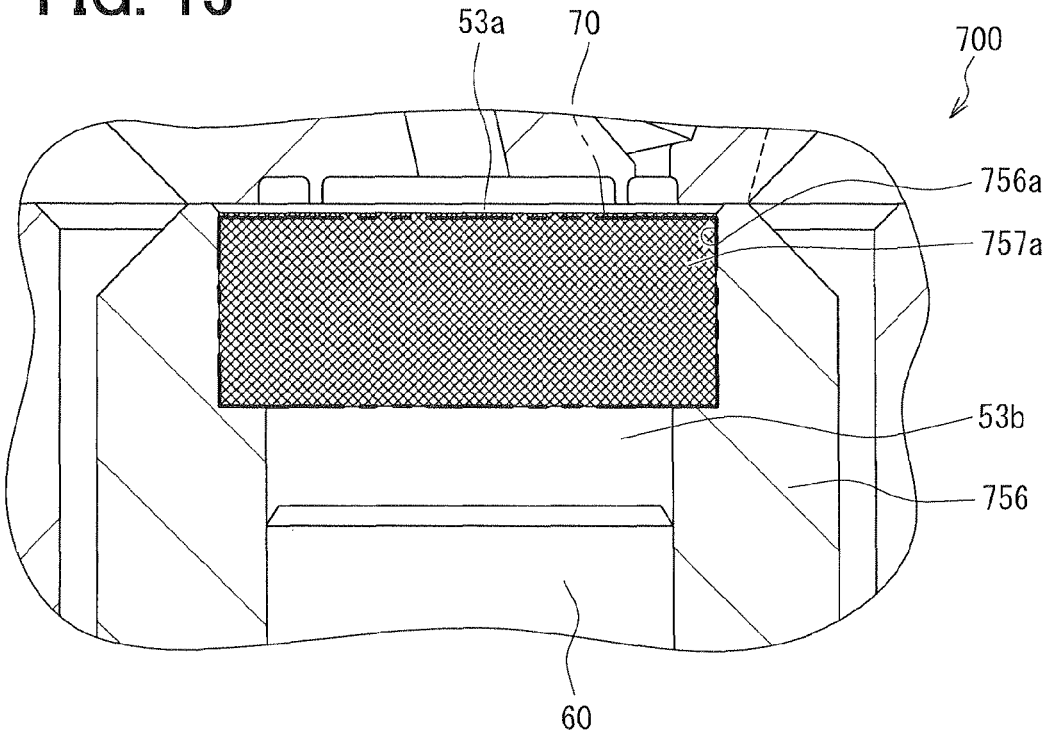
FIG. 13 is a cross-sectional view showing a portion of a fuel injection device according to a seventh embodiment of the present invention, which is a modification example of FIG. 12.

A sixth embodiment and a seventh embodiment of the present invention shown in FIGS. 12 and 13 are another modified example of the second embodiment. A fuel injection devices 600, 700 of the sixth embodiment and the seventh embodiment includes cylinders 656, 756 respectively corresponding to the cylinder 256 (see FIG. 6) in the second embodiment. On each of the inner wall surface portions 656*a*, 756*a* of the cylinders 656, 756, knurling is formed as communication grooves 657*a*, 757*a*, so as to make the inflow chamber 53*a* communicate with the back pressure chamber 53*b*. For example, what defined in the JISB-0951 is suit to this kind of the knurling.

Specifically, as shown in FIG. 12, the knurling as the communication groove 657*a* in the sixth embodiment is configured by equally spacing microgrooves extending along the axial direction of the cylinder 656 from each other in the circumferential direction of the cylinder 656. The knurling of FIG. 12 corresponds to a parallel-type one defined in the above-described JISB-0951. The fuel introduced into the inflow chamber 53*a* flows through the knurling and passes the floating plate 70 in the displacement axial direction, and thereby the fuel reaches the back pressure chamber 53*b*.

Furthermore, as shown in FIG. 13, the knurling as the communication groove 757*a* in the seventh embodiment is configured by equally spacing microgrooves, which are spirally wound around and extends along the central axis of the cylinder 756, from each other in the circumferential direction of the cylinder 656. By changing a rotating direction of each spiral groove, the multiple microgrooves are crossed each other, and this makes stripe pattern. The knurling corresponds a diamond knurling defined in the above-described JISB-0951. The fuel introduced into the inflow chamber 53*a* flows through the knurling and passes the floating plate 70 in the displacement axial direction, thereby flowing into the back pressure chamber 53*b*.

As described in the sixth and seventh embodiments, the knurling can be formed as the communication grooves 657*a*, 757*a*. Even the knurling described above allows for fuel flowing from the inflow channel 53*a* into the back pressure chamber 53*b*, so that the pressure recovery in the back pressure chamber 53*b* can be quickly achieved. Therefore, the response of the nozzle needle 60 at the valve closing time can be improved.

(Eighth Embodiment)

Figure 14:
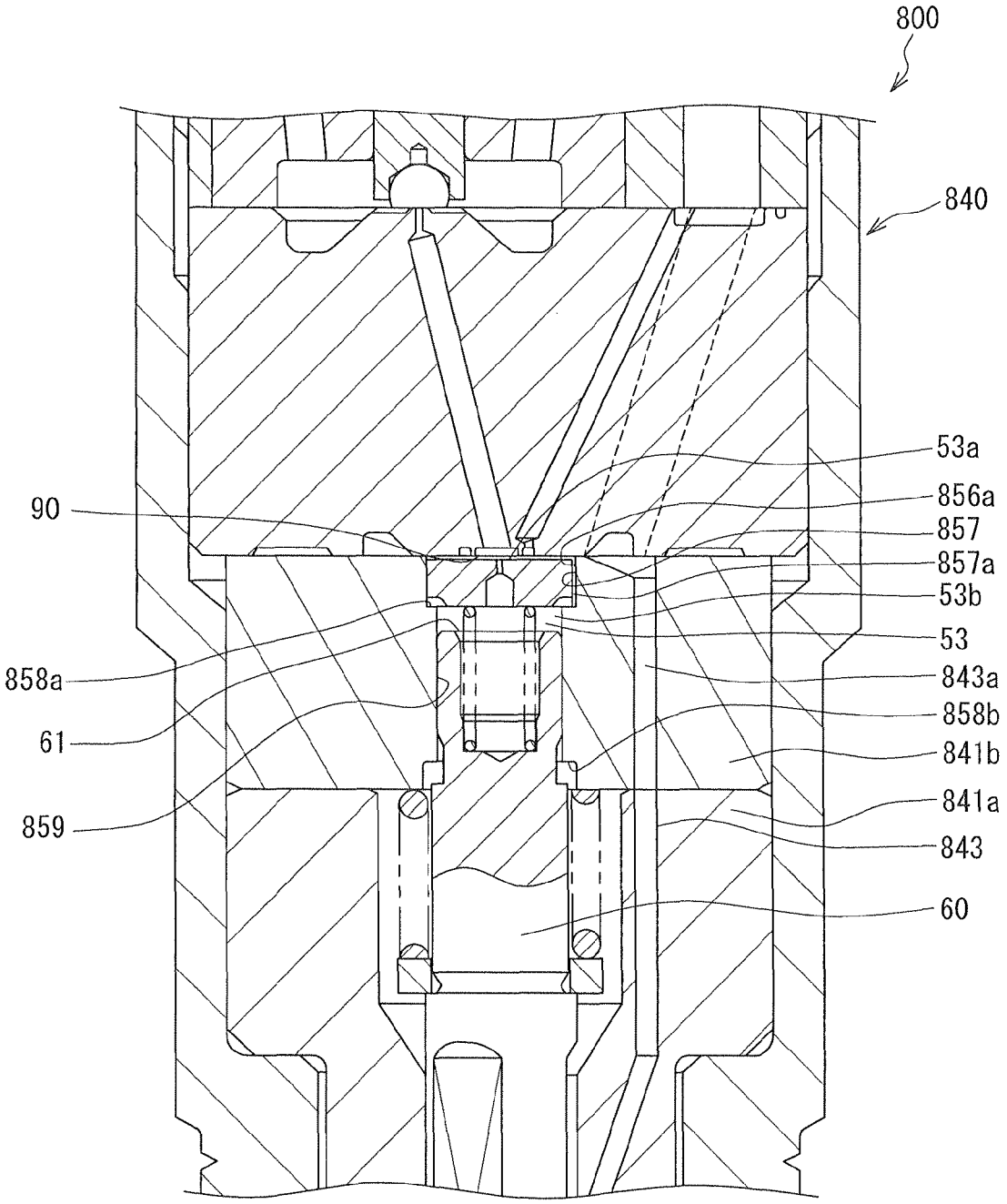
FIG. 14 is a cross-sectional view showing a portion of a fuel injection device according to the seventh embodiment of the present invention, which is another modification example of FIG. 3.

An eighth embodiment shown in FIG. 14 is also another modification example of the first embodiment. In a fuel injection device 800 of the eighth embodiment, a structure corresponding to the cylinder 56 (see FIG. 3) defining the radial direction of the pressure control chamber 53 in the first embodiment is omitted. In addition, as a structure corresponding to the nozzle body 41 (see FIG. 3) in the first embodiment, a first nozzle body 841*a* and a second nozzle body 841*b* are provided. Hereinafter, the construction of the fuel injection device 800 according to the eighth embodiment will be described based on FIG. 14.

The first nozzle body 841*a* and the second nozzle body 841*b* are arranged in this order from a tip end of a control body 840. The injection hole 44 (see FIG. 2) is configured on a tip end of the first nozzle body 841*a*. The pressure control chamber 53 is arranged within the second nozzle body 841*b*.

The first nozzle body 841*a* and the second nozzle body 841*b* include a nozzle needle housing portion 843 and a supply channel 843*a*. The nozzle needle housing portion 843 and the supply channel 843*a* correspond to the nozzle needle housing portion 43 and the supply channel 43*a* of the first embodiment, respectively.

The nozzle needle housing portion 843 is located in radially central portion of the first nozzle body 841*a* and the second nozzle body 841*b*, and is configured to form in the nozzle bodies 841*a*, 841*b*. On an inner wall surface portion 856*a* of the side of the second nozzle body 841*b*, a control wall surface portion 857, a cylinder sliding surface portion 859, a plate stopper portion 858*a*, and a needle stopper portion 858*b* are provided as the nozzle needle housing portion 843. The control wall surface portion 857, the cylinder sliding surface portion 859, the plate stopper portion 858*a* and the needle stopper portion 858*b* are substantially similar to the corresponding components 57, 59, 58*a*, 58*b* (see FIG. 3) formed in the inner wall surface portion 56*a* of the cylinder 56 in the first embodiment. The pressure control chamber 53 of the eighth embodiment is defined by the control wall surface portion 857 of the second nozzle body 841*b*, the pressure receiving surface 61 of the nozzle needle 60, and the opening-wall surface 90.

A supply passage 843*a* is located at an outer peripheral side of the pressure control chamber 53 and configured to extend in the first nozzle body 841*a* and the second nozzle body 841*b*. The supply passage 843*a* extends along the axial direction of the control body 840 and is connected to the nozzle needle housing portion 843 at tip end side in the axial direction. Thereby, the supply passage 843*a* supplies the high-pressurized fuel with the nozzle needle housing portion 843.

In the control body 840 of the above-described eight embodiment, the pressure control chamber 53 and the supply passage 843*a* are arranged. The pressure control chamber 53 limits the movement of the nozzle needle 60, and the supply passage 843*a* is a portion through which the high-pressurized fuel flows into the injection hole 44 (see FIG. 2). In the first embodiment, by the cylinder 56 held within the nozzle needle housing portion 43, the pressure control chamber 53 is divided from the supply passage 43*a* (see FIG. 3). On the other hand, in the eighth embodiment, the supply passage 843*a* is arranged at the outer peripheral side of the pressure control chamber 53, so that the pressure control chamber 53 is defined by the second nozzle body 841*b* in a state where the pressure control chamber 53 is divided from the supply passage 843*a*.

As described above, the component that defines the pressure control chamber 53 may be changed, depending on the configuration of the fuel injection device. However, regardless of the component defining the pressure control chamber 53, if a communication groove 857*a* is formed on the inner wall surface portion 856*a* that defines the pressure control chamber 53 and this allows the fuel flow from the inflow chamber 53*a* into the back pressure chamber 53*b*, the pressure recovery in the back pressure chamber 53*b* can be quickly achieved. Thereby, regardless of the configuration of the fuel injection device, forming the communication groove 857*a* results in the improvement of the response of the nozzle needle 60 at the valve closing time.

In the eighth embodiment, the control body 840 is an example of a valve body described in claims, the first nozzle body 841*a* and the second nozzle body 841*b* are examples of nozzle member described in claims, and the inner wall surface portion 856*a* is an example of a cylindrical inner wall portion described in claims.

Although the present invention has been fully described in connection with the preferred embodiments thereof with reference to the accompanying drawings, it is to be noted that various changes and modifications will become apparent to those skilled in the art.

In the above-described embodiment, the configuration, in which two to four communication grooves are arranged and equally spaced from each other in the circumferential direction of the cylinder on the inner wall surface portion, is mentioned. However, the number, the position and the configuration of the communication groove are not limited to this. For example, only one communication groove can be arranged on the inner wall surface portion of the cylinder in the fuel injection device.

In the above-described embodiment, either the slidable contact wall surface or the communication wall portion is provided between the communication grooves arranged on the inner wall surface portion of the cylinder. However, both the slidable contact wall surface and the communication wall portion can be provided. This providing results in the limitation of the inclination of the floating plate and the ensuring sufficient fuel flow from the inflow chamber 53*a* into the back pressure chamber 53*b*.

In the above-described third embodiment, the channel area of the sub-communication groove 357*g* is configured to become larger toward the downstream side. However, the configuration of the sub-communication groove 357*g* is not limited to the configuration of the third embodiment. For example, the sub-communication groove can extend along the radial direction and be configured to have a homogeneous channel area. Furthermore, the number and the position of the sub-communication groove are not limited to the above-described configuration.

In the above-described embodiment, in the axial direction of the fuel injection device, the pressure control chamber 53 is arranged in a portion closer to the tip end side, in which the injection hole 44 is formed, than the base end side, in which the socket portion 48*c* is provided. However, in a conventionally prevailing fuel injection device, a configuration corresponding to the pressure control chamber for controlling the movement of the nozzle needle is arranged in a location closer to the base end side than tip end side. The present invention can be applied to this conventionally prevailing fuel injection device. More particularly, in the above-described first to seventh embodiment, by the multiple components forming the control body, especially by the cylinder, the pressure control chamber 53 is defined. In the eighth embodiment, the pressure control chamber 53 is defined mainly by the second nozzle body 841*b*. However, the pressure control chamber 53 can be defined by components, which form the control body and are other than the cylinder and the nozzle body, such as a component corresponding to the holder 48 in the above-described embodiment.

In the above-described embodiment, the structure for moving the movable member by the electromagnetic force of the solenoid 31 is used, as a driving portion for opening and closing the pressure control valve 80, which controls the fuel pressure in the pressure control chamber 53. However, the drive portion other than the solenoid 31, e.g., a piezo-electric element, can be used. Even in this case, the driving portion for opening and closing a pressure control valve 80 can be operated based on the control signal from an engine controller 17.

In the above embodiments, the present invention is applied to the fuel injection device used for a diesel engine 20 that injects fuel directly into a combustion chamber 22. However, the present invention may be applied to a fuel injection device for any internal combustion engine such as an Otto cycle engine and like without being limited to the diesel engine 20. In addition, the fuel injected by the fuel injection device is not limited to light oil but may be gasoline, liquefied petroleum gas, and like. Furthermore, the present invention may be applied to a fuel injection device that injects fuel to a combustion chamber of an engine for burning fuel such as an external combustion engine.

What is claimed is:

1. A fuel injection device comprising:

a valve body in which a high-pressure fuel passage is provided, the valve body having an injection hole at a tip end, from which the high-pressure fuel is injected into a combustion chamber of an internal combustion engine;

a valve member which is movable in an axial direction of the valve body in an inside of the valve body, and opens or closes the injection hole;

a pressure control chamber which is provided within the valve body at a side opposite from the injection hole with respect to the valve member, and which introduces the high-pressure fuel and controls the movement of the valve member by using fuel pressure;

an inflow channel through which the high-pressure fuel is introduced to the pressure control chamber;

an outflow channel through which the fuel from the pressure control chamber is discharged to an exterior low-pressure side; and a control member which is movable in the axial direction of the valve body in an inside of the valve body, and opens or closes the inflow channel, wherein the valve body includes a cylindrical inner wall portion defining the pressure control chamber in a radial direction thereof, and the cylindrical inner wall portion includes a communication groove which causes an inflow chamber that is provided within the pressure control chamber at a side of the inflow channel relative to the control member, to communicate with a back pressure chamber that is provided within the pressure control chamber at a side of the valve member relative to the control member, wherein a plurality of the communication grooves are arranged and spaced from one another in a circumferential direction on the cylindrical inner wall portion, and wherein the communication grooves are equally spaced from one another in the circumferential direction.

2. The fuel injection device according to claim 1, wherein the cylindrical inner wall portion is provided with a slidable contact wall surface at an outer peripheral wall portion around a displacement axis of the control member.

3. The fuel injection device according to claim 1, wherein the cylindrical inner wall portion is provided with a communication wall surface defining a communication clearance between the cylindrical inner wall portion and an outer peripheral wall around a displacement axis of the control member, and the communication clearance causes the inflow chamber to communicate with the back pressure chamber.

4. The fuel injection device according to claim 1, wherein a bottom portion of the communication groove has an arcuate shape on a cross section in the radial direction.

5. The fuel injection device according to claim 1, wherein the valve body is provided with a limiting portion that is opposed to an end surface of the control member at a side of the back pressure chamber, and the limiting portion is provided with a sub-communication groove that causes the inflow chamber to communicate with the back pressure chamber together with the communication groove.

6. The fuel injection device according to claim 5, wherein the limiting portion is configured in a stepped shape protruding toward a radially inside of the cylindrical inner wall portion.

7. The fuel injection device according to claim 5, wherein the sub-communication groove is configured to increase a channel area as approaching downstream in a fuel flow direction from the inflow chamber to the back pressure chamber.

8. The fuel injection device according to claim 5, wherein the cylindrical inner wall portion includes a plurality of the communication grooves spaced from one another in a circumferential direction, the limiting portion includes a plurality of the sub-communication grooves that are connected to the communication grooves, respectively, and are spaced from one another in the circumferential direction, and the communication grooves and the sub-communication grooves are equally spaced form one another in the circumferential direction.

9. The fuel injection device according to claim 5, wherein a bottom portion of the communication groove is configured to a circular arc shape in the radial cross section, and the sub-communication groove is configured to a circular arc shape that is co-axial with the bottom portion and has a same radius as the bottom portion.

10. The fuel injection device according to claim 9, wherein a center of the circular arc shape of the sub-communication groove is located radially inside of the limiting portion.

11. The fuel injection device according to claim 1, wherein the communication grooves are configured by knurling provided in the cylindrical inner wall portion.

12. The fuel injection device according to claim 1, wherein the communication grooves extends along the axial direction.

13. The fuel injection device according to claim 1, wherein the communication groove is spirally wound around and extends along a central axis of the cylindrical inner wall portion.

14. The fuel injection device according to claim 1, wherein the valve body is provided with a supply passage through which the high-pressure fuel is supplied into the injection hole arranged at the tip end, and the valve body has a cylindrical member that is held within the supply passage, defines the cylindrical inner wall portion at an inner peripheral side, and divides the pressure control chamber from the supply passage.

15. The fuel injection device according to claim 1, wherein the valve body has a nozzle member forming the tip end in which the injection hole is provided, and the nozzle member defines the pressure control chamber by the cylindrical inner wall portion, and the supply passage that is positioned at an outer peripheral side of the pressure control chamber to supply the high-pressure fuel into the injection hole.

16. The fuel injection device according to claim 1, wherein the communication grooves are arranged radially outside of the control member.

* * * * *